US011181239B2

(12) United States Patent
Qiu

(10) Patent No.: US 11,181,239 B2
(45) Date of Patent: Nov. 23, 2021

(54) ADJUSTABLE LIGHTING LAMP AND APPLICATION THEREOF

(71) Applicant: NINGBO FUTAI ELECTRIC LIMITED, Zhejiang (CN)

(72) Inventor: Fujun Qiu, Ningbo (CN)

(73) Assignee: NINGBO FUTAI ELECTRIC LIMITED, Zhejiang (CN)

( * ) Notice: Subject to any disclaimer, the term of this patent is extended or adjusted under 35 U.S.C. 154(b) by 328 days.

(21) Appl. No.: 16/258,642

(22) Filed: Jan. 27, 2019

(65) Prior Publication Data

US 2019/0242531 A1 Aug. 8, 2019

(30) Foreign Application Priority Data

Feb. 5, 2018 (CN) ..... 201810114232.8
Feb. 5, 2018 (CN) ..... 201820119334.X

(51) Int. Cl.

| | |
|---|---|
| ***F21K 9/00*** | (2016.01) |
| ***F21K 9/20*** | (2016.01) |
| ***H01R 13/717*** | (2006.01) |
| ***F21V 23/00*** | (2015.01) |
| ***F21L 4/02*** | (2006.01) |
| ***F21L 4/04*** | (2006.01) |
| ***F21V 23/04*** | (2006.01) |
| *H01R 35/02* | (2006.01) |

(52) U.S. Cl.

CPC ..... *F21K 9/20* (2016.08); *F21L 4/027* (2013.01); *F21L 4/045* (2013.01); *F21V 23/008* (2013.01); *F21V 23/0414* (2013.01); *H01R 13/717* (2013.01); *H01R 35/02* (2013.01)

(58) Field of Classification Search

CPC ..... F21K 9/20; H01R 13/717; F21L 4/027; F21L 4/045; F21V 23/008; F21V 23/0414

See application file for complete search history.

(56) References Cited

U.S. PATENT DOCUMENTS

2011/0149562 A1* 6/2011 Spartano ..... F21L 4/045 362/197
2014/0168991 A1* 6/2014 Kim ..... F21V 15/013 362/297
2015/0267902 A1* 9/2015 Zhang ..... F21L 4/04 362/188
2017/0205058 A1* 7/2017 Ostrander ..... B60Q 3/35
2017/0292659 A1* 10/2017 Bayat ..... F21V 23/0428

(Continued)

*Primary Examiner* — Gerald J Sufleta, II
(74) *Attorney, Agent, or Firm* — Raymond Y. Chan; David and Raymond Patent Firm

(57) ABSTRACT

An adjustable lighting lamp includes a lamp head, a lamp body and a connector movably connect the lamp head with the lamp body for adjusting an illumination direction of the lamp head. The connector of the light lamp includes a coupling base connected to the lamp body and a linkage protrusion connected to the lamp head and configured to adjust the light lamp being switched between a first illumination state in which the illumination direction of the lamp head is aligned with an extending direction of the lamp body, a second illumination state in which the illumination direction of the lamp head is perpendicular to the extending direction of the lamp body, and a third illumination state in which an angle between the illumination direction of the lamp head and the extending direction of the lamp body define an obtuse angle.

4 Claims, 15 Drawing Sheets

(56) References Cited

U.S. PATENT DOCUMENTS

| | | | | |
|---|---|---|---|---|
| 2017/0307151 | A1* | 10/2017 | Deng | F21S 6/003 |
| 2018/0031214 | A1* | 2/2018 | Li | F21V 17/02 |
| 2020/0281297 | A1* | 9/2020 | Kaye | F21L 4/02 |
| 2020/0332986 | A1* | 10/2020 | Xia | F21V 21/10 |
| 2021/0033248 | A1* | 2/2021 | Cacciabeve | F21L 4/04 |

* cited by examiner

ADJUSTABLE LIGHTING LAMP AND APPLICATION THEREOF

CROSS REFERENCE OF RELATED APPLICATION

This application is a non-provisional application that claims priority to China application number CN201810114232.8, filing date Feb. 5, 2018, and China application number CN201820119334.X, filing date Feb. 5, 2018, wherein the entire content of which is expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an illumination appliance, and more particularly to an adjustable lighting lamp and application thereof.

Description of Related Arts

The lamp is a great invention of human beings for conquest of the night. In our lives, whether it is used for lighting or decoration, it has become an indispensable part.

In order to facilitate lighting in movement and motion, a variety of hand-held illuminating devices, head-mounted illuminating devices, wristband-type illuminating devices and illuminating tools that can be easily fixed to other tools have been proposed, and flashlights are the most common lighting devices among these illuminating devices. Common flashlights can be divided into two types: hand-held and hand-held. With the continuous improvement of the quality of the lamp bead, the illumination range and illumination distance of the flashlight can basically meet the daily needs. However, many flashlights, which are inconvenient to carry and are still relatively large, have not disappeared in the market because these flashlights are advantageous in that they perform well in light direction adjustment in comparison with flashlights with relatively small size. More specifically, due to their relatively large sizes, adjustment can be easier, and it is easier to obtain a suitable illumination angle, and a greater mass makes the center of gravity of the flashlight be more stable.

Generally, a large-sized flashlight which is capable of adjusting its illuminating direction is generally provided with an adjustment bracket, and the illumination direction of the flashlight is changed by adjusting the bracket. The adjusting bracket basically changes an illumination direction of the flashlight by axial rotation, and supports a barrel of the flashlight on the supporting surface. For example, axially rotatable brackets are respectively installed on both sides of the lamp barrel, and the principle of operation is that the barrel is like a swing seat, and the bracket is like a rope that suspends the seat, so that by changing the angle between the lamp and the bracket, the change of the illumination direction of the flashlight can be achieved. Alternatively, two brackets are respectively mounted on the same side of the lamp barrel. For instance, two brackets are respectively mounted on front and rear portions of the barrel, by changing the angle between the brackets and the barrel, a height difference is created between the two brackets so as to raise or lower a head of the flashlight, thereby changing the illumination direction of the flashlight. That is to say, the larger flashlights benefit from its large volumetric shape, and an adjustment space is relatively large, so that it is easy to adjust the illumination direction, and thus more accurate illumination angles can be obtained, and also the stability of the illumination of varied angles is improved due to its large mass. However, the larger flashlights are not convenient to carry, and though they are advantageous in the performance of the adjustment function of the brackets, the use of the flashlights themselves are limited, because once the brackets are damaged, even if the flashlights themselves do not have any malfunctions, their use value will be largely discounted.

In summary, the current adjustment of illumination directions of the flashlight is almost always achieved by changing the placement angle of the entire flashlight, so that even if the adjustment of the light direction is achieved, new problems arise in the process of stabilizing the light direction and adjusting the light direction. A flashlight that is really easy to adjust the light direction and can stably fix the light direction needs to be proposed.

SUMMARY OF THE PRESENT INVENTION

The invention is advantageous in that it provides a lighting lamp and application thereof, wherein radiation and illumination angles of light beams of the lighting lamp are capable of being adjusted.

Another advantage of the invention is to provide a lighting lamp and application thereof, wherein the radiation directions of the light provided by the lighting lamp can be adjusted at multiple angles.

Another advantage of the present invention is to provide a lighting lamp and application thereof, wherein the lighting lamp can be automatically maintained in an adjusted state.

Another advantage of the present invention is to provide a lighting lamp and application thereof, wherein when a suitable external force is applied to the lighting lamp, the radiation direction of the light provided by the lighting lamp can be adjusted, and when the external force applied to the lighting lamp is revoked, the lighting lamp can be automatically maintained in an adjusted state to make the lighting lamp be particularly convenient to use.

Another advantage of the present invention is to provide a lighting lamp and application thereof, wherein the lighting lamp provides a lamp head and a lamp body, wherein the radiation angles of light beams generated by the lamp head can be adjusted by adjusting the angle of the lamp head relative to the lamp body.

Another advantage of the present invention is to provide a lighting lamp and application thereof, wherein the lighting lamp provides a connector for connecting the lamp head and the lamp body, and under action of the connector, it is able to provide a first illumination state, a second illumination state and a third illumination state, when the lighting lamp is in the first illumination state, the illumination light of the light emitted by the lighting lamp is consistent with an extending direction of the lamp body; when the lighting lamp is in the second illumination state, the illumination light of the light emitted by the lamp is perpendicular to the extending direction of the lamp body; when the lighting lamp is in the third illumination state, the illumination direction of the light emitted by the lighting lamp and the extension direction of the lamp body define an obtuse angle.

Another advantage of the present invention is to provide a lighting lamp and application thereof, wherein the lamp head and the lamp body are connected and fixed at a plurality of angles by the connector, so that the lighting lamp can provide multiple illumination angles by the lamp head.

Another object of the present invention is to provide a lamp and the lamp body thereof, wherein the lamp head and the lamp body are detachably connected for quickly customizing the connection angle between the lamp head and the lamp body. In other words, the desired angle of illumination can be quickly obtained by the connection angle of the lamp head and the lamp body, so as to facilitate the convenient use.

Another advantage of the present invention is to provide a lighting lamp and application thereof, wherein a connecting surface of the lamp head and the lamp body is an inclined supporting surface, so that the lamp head and the lamp body are capable of moving with respect to each other under the action of the connector and causing the lighting lamp to switch between the first illumination state and the second illumination state.

Another advantage of the present invention is to provide a lighting lamp and application thereof, wherein the connector adjusts a relative movement between the lamp head and the lamp body in a segmented fine adjustment manner, thereby causing the lamp head and the lamp body to be assembled with a variety of connection angles, so as to provide multiple angles of illumination.

Another advantage of the present invention is to provide a lighting lamp and application thereof, wherein the connector adjusts a relative movement between the lamp head and the lamp body in a segmented fine adjustment manner, when the lamp head and the lamp body are moved with respect to each other change the connection angle, the connector maintains the connection angle between the lamp head and the lamp body, thereby providing a stable illumination angle by an illumination element of the lighting lamp.

Another advantage of the present invention is to provide a lighting lamp and application thereof, wherein the lighting lamp can be magnetically fixed to a metal, a metal alloy and a magnet, so as to liberate the user's hands when provide multiple angles of illumination.

Another advantage of the present invention is to provide a lighting lamp and application thereof, regardless of the connection angle between the lamp head and the lamp body, the center of gravity of the lighting lamp is always positioned at the lamp body, and further, the lighting lamp is always capable of providing stable illumination directions.

Another advantage of the present invention is to provide a lighting lamp and application thereof, wherein the lamp head and the lamp body can be detachably separated, so that the lamp head and the lamp body of the same type can be used interchangeably to improve product utilization rate.

Another advantage of the present invention is to provide a lighting lamp and application thereof, wherein the lamp head and the lamp body are detachably separable and electrically connect the circuit while being connected to facilitate the function of providing illumination.

Another advantage of the present invention is to provide a lighting lamp and application thereof, wherein the lighting lamp provides a variety of illumination manners to facilitate the user's needs.

Another advantage of the present invention is to provide a lighting lamp and application thereof, wherein the lighting lamp comprises a lamp head protection cover and a lamp body protection cover which are respectively sleeved on the lamp body and the lamp body, so as to avoid damage to the lamp head and the lamp body due to bumping.

Additional advantages and features of the invention will become apparent from the description which follows, and may be realized by means of the instrumentalities and combinations particularly pointing out in the appended claims.

According to one aspect of the present invention, the present invention provides a lighting lamp comprising a lamp body; and a lamp head adjustably provided on the light body, wherein the lighting lamp, which has a first illumination state, a second illumination state, and a third illumination state, is capable of switching between the first illumination state, the second illumination state, and the third illumination state by adjusting a relative position between the lamp head and the lamp body.

According to an embodiment of the present invention, the light lamp further comprises at least one connector movably connecting the lamp head with the lamp body.

According to an embodiment of the present invention, each of the at least one connector further comprises a coupling base fixed and mounted to the lamp body; and a linkage protrusion fixed and mounted to the lamp head, wherein the coupling base is movably connected with the linkage protrusion, and when a relative movement between the coupling base and the linkage protrusion takes place, the lamp head and the lamp body correspondingly move with respect to each other in response to the relative movement between the coupling base and the linkage protrusion, so as change an illumination direction of the lamp head by changing a connection angle between the lamp head and the lamp body.

According to an embodiment of the present invention, the coupling base further comprises a retaining stop and a fixing member, wherein the retaining stop is fixedly mounted on the lamp body, wherein the retaining stop has a fixing hole and a communication hole formed at a bottom of the fixing hole; wherein the fixing member is movably disposed in the fixing hole, wherein the fixing member has a positioning through hole and at least one receiving hole which is in communication with the positioning through hole, wherein by placing the fixing member in the fixing hole, the positioning through hole is disposed in the fixing hole, wherein the linkage protrusion comprises at least one positioning protrusion, wherein the linkage protrusion is placed in the communication hole and the positioning through hole so as to be movably connected to the couple base, wherein the positioning protrusion is placed in the receiving hole, wherein when the fixing member is rotated in the fixing hole, the positioning protrusion will be driven to rotate by an wall around the receiving hole.

According to an embodiment of the present invention, the coupling base further comprises a stopping member which is provided with a fixing arm at one end thereof and has at least one stopping hole at the other end thereof, wherein the linkage protrusion has a fixing groove, the retaining stop is further provided with at least one stopping protrusion, wherein the linkage protrusion is placed in the communication hole and the positioning through hole at the same time, the fixing arm is placed at the fixing groove, the linkage protrusion is clamped to the fixing arm, the stopping protrusion is disposed at the stopping hole, so as to fix the other end of the stopping member, and prevents the linkage protrusion to be moved out from the fixing groove.

According to an embodiment of the present invention, an hole wall around the fixing hole is provided with a plurality of adjacently arranged retaining grooves, wherein the fixing member is provided with at least two retaining protrusions, and a specification of each of the retaining grooves matches with a specification of each of the at least two retaining protrusions and is slightly larger than each of the at least two retaining protrusions, wherein by placing the fixing member in the fixing hole, each of the retaining protrusions is placed in one of the retaining grooves, wherein when the lamp head is driven to rotate by an external force, each of the at least two retaining protrusions will be rotated in response to rotation of the lamp head and sequentially switched into different the retaining grooves, thereby the connection angle between the lamp head and the lamp body will be change accordingly.

According to an embodiment of the present invention, the retaining stop further has at least one guiding groove, wherein the linkage protrusion is further provided with at least one guiding member, wherein the linkage protrusion is movably connected to the coupling base, the guiding member is placed in the guiding groove, wherein when the lamp head is driven by the external force to sequentially switch each of the at least two retaining protrusions into different retaining grooves, the guiding member slides along the guide groove.

According to an embodiment of the present invention, the connection angle between the lamp head and the lamp body is arranged from 90 degrees to 180 degrees, wherein when the lamp is switched from the first illumination state to the second illumination state, or from the second illumination state to the first illumination state, the linkage protrusion is rotated with respect the retaining stop by 180 degrees.

According to an embodiment of the present invention, the lamp head comprises a first circuit unit, wherein the first circuit unit is provided with at least one illumination element, wherein the lamp body comprises a second circuit unit, wherein the second circuit unit is provided with a switch member and a power supply member, wherein by movably connecting the lamp head with the lamp body through the connector, the first circuit unit and the second circuit unit form a complete circuit, wherein when the switch member is in a closed state, the power supply member functions to provide power to the at least one illumination element to provide illumination.

According to an embodiment of the present invention, the retaining stop comprises at least two second electrical conductive members, the fixing member comprises at least two first electrical conductive members, and the linkage protrusion comprises at least two third electrical conductive members, wherein by placing the fixing member in the fixing hole, the each of the at least two third electrical conductive members is respectively in contact with each of corresponding the at least two first electrical conductive members and each of corresponding the at least two second electrical conductive members, so that the first circuit unit and the second circuit unit form the complete circuit.

According to an embodiment of the present invention, the lamp body further comprises a body protection cover, a body housing and an auxiliary fixing member, wherein the auxiliary fixing member and the body protection cover are provided at one end of the body housing, wherein the second electrical circuit unit and the power supply member are both disposed in the body housing, wherein the auxiliary fixing member is capable of being magnetically attracted by iron, an alloy containing iron, and a magnet.

According to an embodiment of the present invention, the lamp head further comprises head housing and a head protection element, wherein the head housing comprises a mounting housing, a lens and a light concentrating aperture, wherein the first electrical circuit unit, the lens and the light concentrating aperture are both disposed in the mounting housing, wherein the head protection element, which is made an elastic material, is disposed at one end of the mounting housing, wherein the illumination element is surrounded by the lighting protection aperture, wherein the lens is mounted to the other end of the mounting housing.

According to an embodiment of the present invention, the illumination element further comprises at least one first illumination member, at least one second illumination member and at least one third illumination member, wherein the at least one first illumination member, the at least one second illumination member and the at least one third illumination member are capable of providing light of different intensities and different illumination directions.

According to another aspect of the present invention, the present invention provides a method of adjusting illumination direction of a lighting lamp comprising the following steps.

(a) Change an angle between a lamp head and a lamp body to change an illumination state of the light lamp.

(b) In response to an external force applied to the lamp head being withdrawn, retain the lamp head and the lamp body in an adjusted illumination state, thereby adjusting the illumination direction of light generated by the lighting lamp.

According to an embodiment of the present invention, wherein in the step (a), change the angle between the lamp head and the lamp body by rotating the lamp head provided on the lamp body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
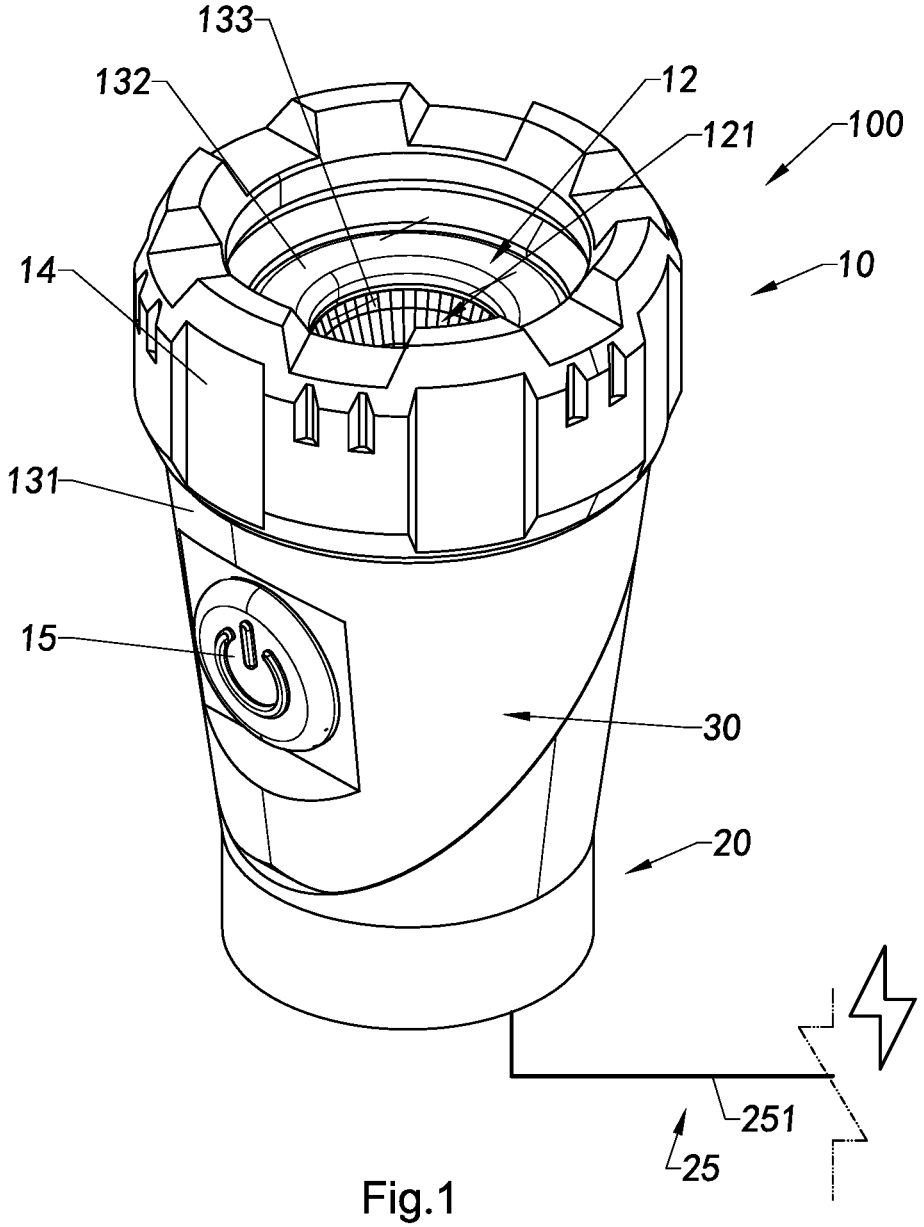
FIG. 1 is a perspective view of a lighting lamp according to a first preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

It is understandable that the term "a" or "an" should be understood as "at least one" or "one or more". In other words, in some embodiments, the number of an element can be one and in other embodiment the number of the element can be more than one. The term "a" or "an" is not construed as a limitation of quantity.

Referring to FIG. 1 to FIG. 6C of the drawings of the present invention, a lighting lamp 100 in accordance with a first preferred embodiment of the present invention is disclosed and illustrated in the following description. The lighting lamp 100 comprises a lamp head 10 and a lamp body 20, the lamp head 10 is adjustably disposed on the lamp body 20, and light beams generated by the lamp head 10 can be changed by adjusting the relative positions of the lamp head 10 and the lamp body 20. The direction of radiation is used to adjust an illumination direction of the lighting lamp 100. Preferably, in a preferred example of the lighting lamp 100 of the present invention, the lamp head 10 is adjustably disposed on the lamp body in such a manner that the lamp head 10 is rotatably coupled to the lamp body 20, whereby the direction of radiation of the light generated by the lamp head 10 can be changed by driving the lamp head 10 to rotate relative to the lamp body 20. In particular, the lamp head 10 of the lighting lamp 100 of the present invention can be provided with at least one illumination element 121 for providing illumination light, for example, when an electrical energy is supplied to the illumination element 121, the illumination element 121 can produce light rays. Nonetheless, it will be understood by those skilled in the art that in other alternative examples of the lighting lamp 100 of the present invention, the illumination element 121 of the lighting lamp 100 can also be embodied as a signal light. It is worth mentioning that the radiation direction of the light generated by the illumination element 121 coincides with the orientation of the lamp head 10, so that the position of the lamp head 10 relative to the lamp body 20 can be adjusted in a synchronous manner when changing the radiation direction of the light generated by the illumination element 121.

Furthermore, the lighting lamp 100 comprises a connector 30 which is used to connect the lamp head 10 and the lamp body 20. In this particular example of the lighting lamp 100 illustrated in FIG. 1 to FIG. 6C, the connector 30 allows the lamp head 10 and the lamp body 20 to be detachably coupled, and after the lamp head 10 and the lamp body 20 are connected by the connector 30, the connector 30 allows a connection angle between the lamp head 10 and the lamp body 20 to be adjusted, thereby allowing the illumination element 121 to provide light with multiple adjustable angles.

The lighting lamp 100 of the present invention has a first illumination state, a second illumination state, and a third illumination state. By adjusting the relative positions of the lamp head 10 and the lamp body 20, the lighting lamp 100 can be switched between the first illumination state, the second illumination state, and the third illumination state, and the lighting lamp 100 can be respectively retained and maintained in any of the first illumination state, the second illumination state, and the three lighting states. Specifically, when the direction of the illumination light provided by the illumination element 121 is consistent with an extending direction of the lamp body 20, the lighting lamp 100 is in the first illumination state; when the direction of the illumination light provided by the illumination element 121 is perpendicular to the extending direction of the lamp body 20, the lighting lamp 100 is in the second illumination state; when the direction of the illumination light provided by the illumination element 121 and the extending direction of the lamp body 20 define an obtuse angle, the lighting lamp 100 is in the third illumination state. The lamp head 10 and the lamp body 20 are movably connected by the connector 30 such that the lighting lamp 100 switches between the first illumination state, the second illumination state and the third illumination state, thereby providing illumination light of different angles by the illumination element 121.

It is worth mentioning that the connection angle between the lamp head 10 and the lamp body 20 can be quickly customized and defined by the detachable structure between the lamp head 10 and the lamp body 20, and thus the illumination member 121 is capable of providing a desired direction of light.

It is worth mentioning that when the relative movement between the lamp head 10 and the lamp body 20 occurs, the lamp head 10 and the lamp body 20 can be retained and maintained at a plurality of connection angles, and are not easily changed. A plurality of light directions is provided by the illumination element 121 by means of different connection angles between the lamp head 10 and the lamp body 20.

The lamp head 10 includes a head housing 13, a first circuit unit 12 and a switch member 15. The first circuit unit 12 is disposed in the head housing 13, and the switch member 15 is provided to the first circuit unit 12. The illumination element 121 is electrically coupled to the first circuit unit 12, and the first circuit unit 12 is always in an open state regardless of whether the switch member 15 is in a closed state or an open state.

The lamp body 20 comprises a body housing 22 and a second circuit unit 25, and the second circuit unit 25 is disposed in the body housing 22, wherein the second circuit unit 25 is always in an open state. When the lamp head 10 is connected to the lamp body 20 through the connector 30, the first circuit unit 12 and the second circuit unit 25 can form a complete circuit, wherein the switch member 15 can control on and off of the complete circuit formed by the first circuit unit 12 and the second circuit unit 25. In other words, when the lamp head 10 and the lamp body 20 are connected to each other through the connector 30, if the switch member 15 is closed, the complete circuit formed by the first circuit unit 12 and the second circuit unit 25 is electrically connected, and the illumination element 121 is illuminating to provide illumination light; and if the switching element 15 is disconnected, the complete circuit formed by the first circuit unit 12 and the second circuit unit 25 will be disconnected to form an open circuit, and the illumination element 121 will not be able to illuminate to provide illumination light. Preferably, in a preferred example of the lighting lamp 100 of the present invention, the first circuit unit 12 and the second circuit unit 25 are automatically with the second circuit unit 25 to form a complete circuit when the lamp head 10 is connected to the lamp body 20 through the connector 30. For example, in a specific example of the lighting lamp 100 of the present invention, when the lamp head 10 is connected to the lamp body 20 through the connector 30, the first circuit unit 12 of the lamp head 10 may be electrically connected to the second circuit unit 25 of the lamp body 20 in a direct contact, thereby causing the first circuit unit 12 and the second circuit unit 25 to form a complete circuit. Alternatively, in another specific example of the lighting lamp 100 of the present invention, when the lamp head 10 is connected to the lamp body 20 through the connector 30, the first circuit unit 12 of the lamp head 10 and the second circuit unit 25 of the lamp body 20 can be respectively connected to conductive members of the connector 30, so that the circuit unit 12 and the second circuit unit 25 are able to form the complete circuit through electrically connecting to conductive members of the connector 30.

Figure 2:
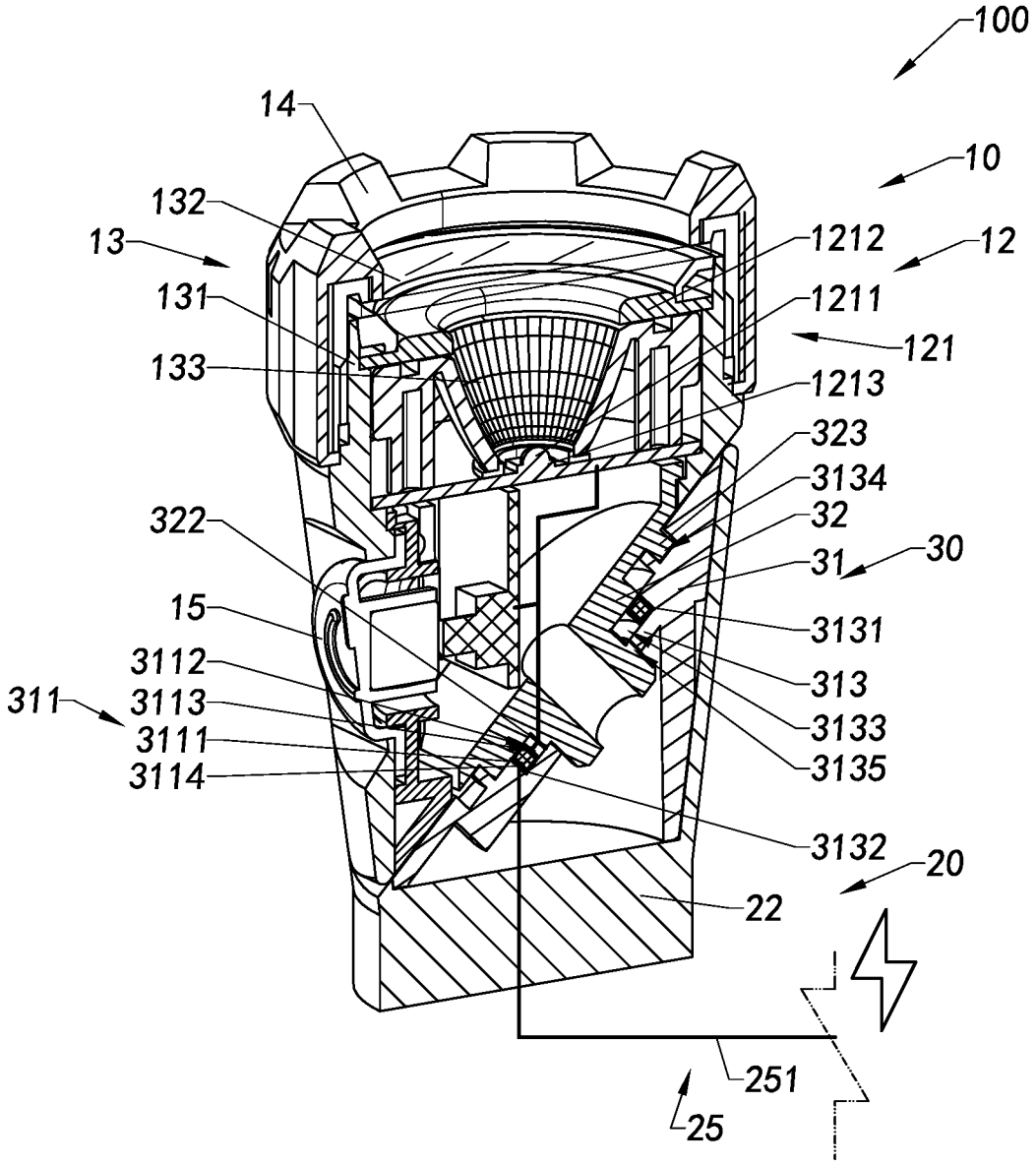
FIG. 2 is a sectional view of the lighting lamp according to the above first preferred embodiment of the present invention.
Figure 3:
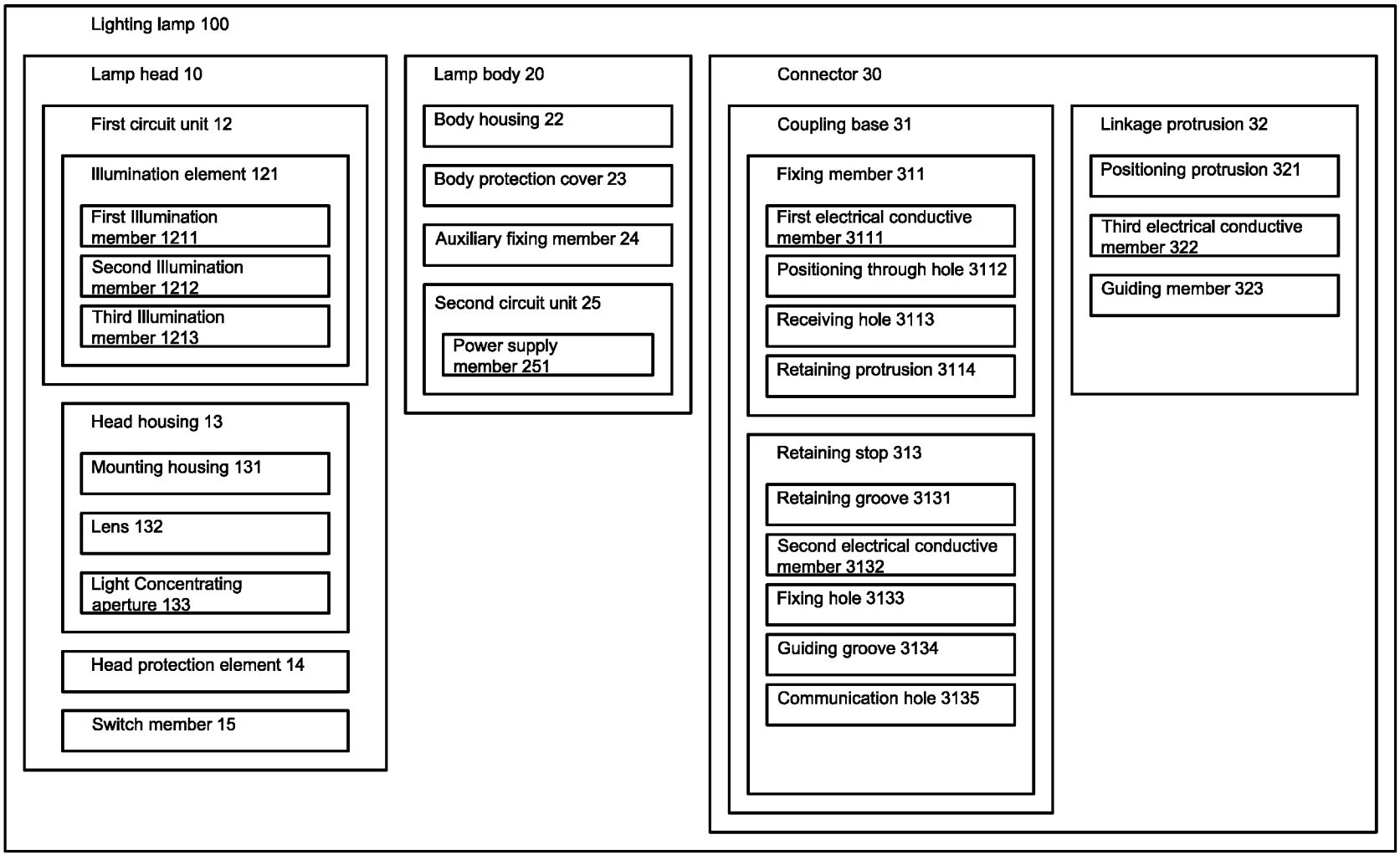
FIG. 3 is a block diagram illustrating the lighting lamp according to the above first preferred embodiment of the present invention.
Figure 4A:
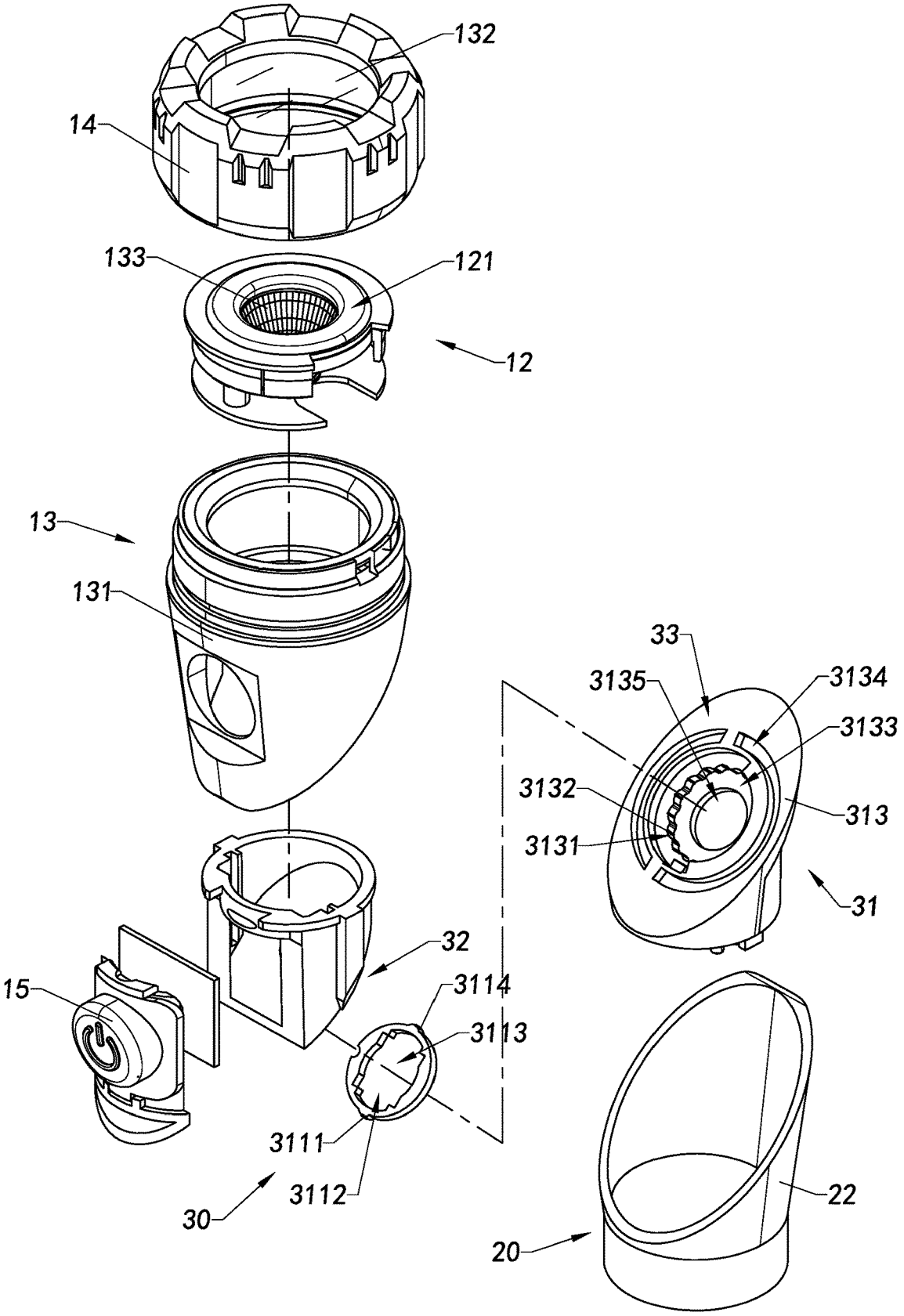
FIG. 4A is an exploded view from one viewing angle of the lighting lamp according to the above first preferred embodiment of the present invention.
Figure 4B:
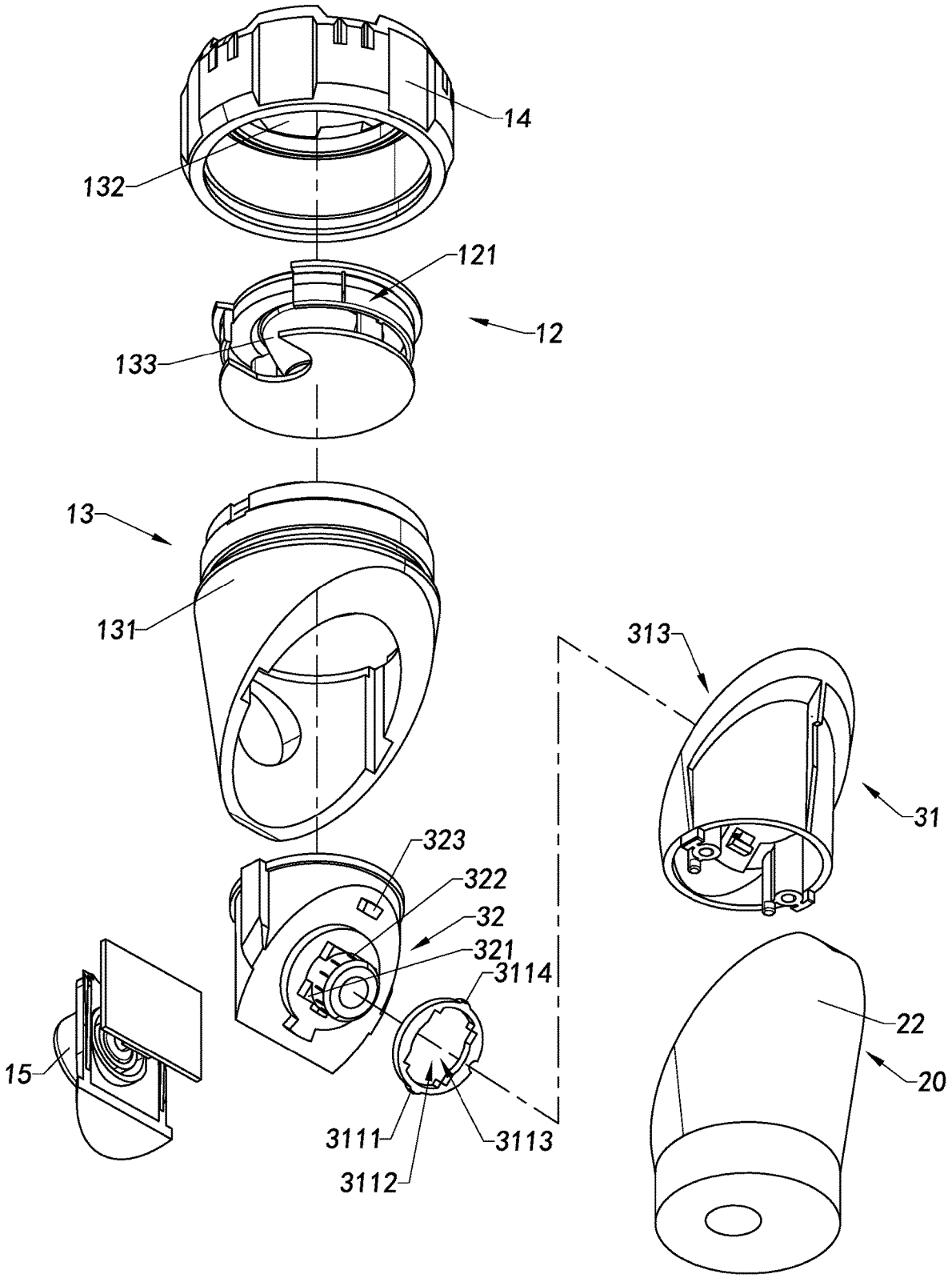
FIG. 4B is an exploded view from another viewing angle of the lighting lamp according to the above first preferred embodiment of the present invention.
Figure 5:
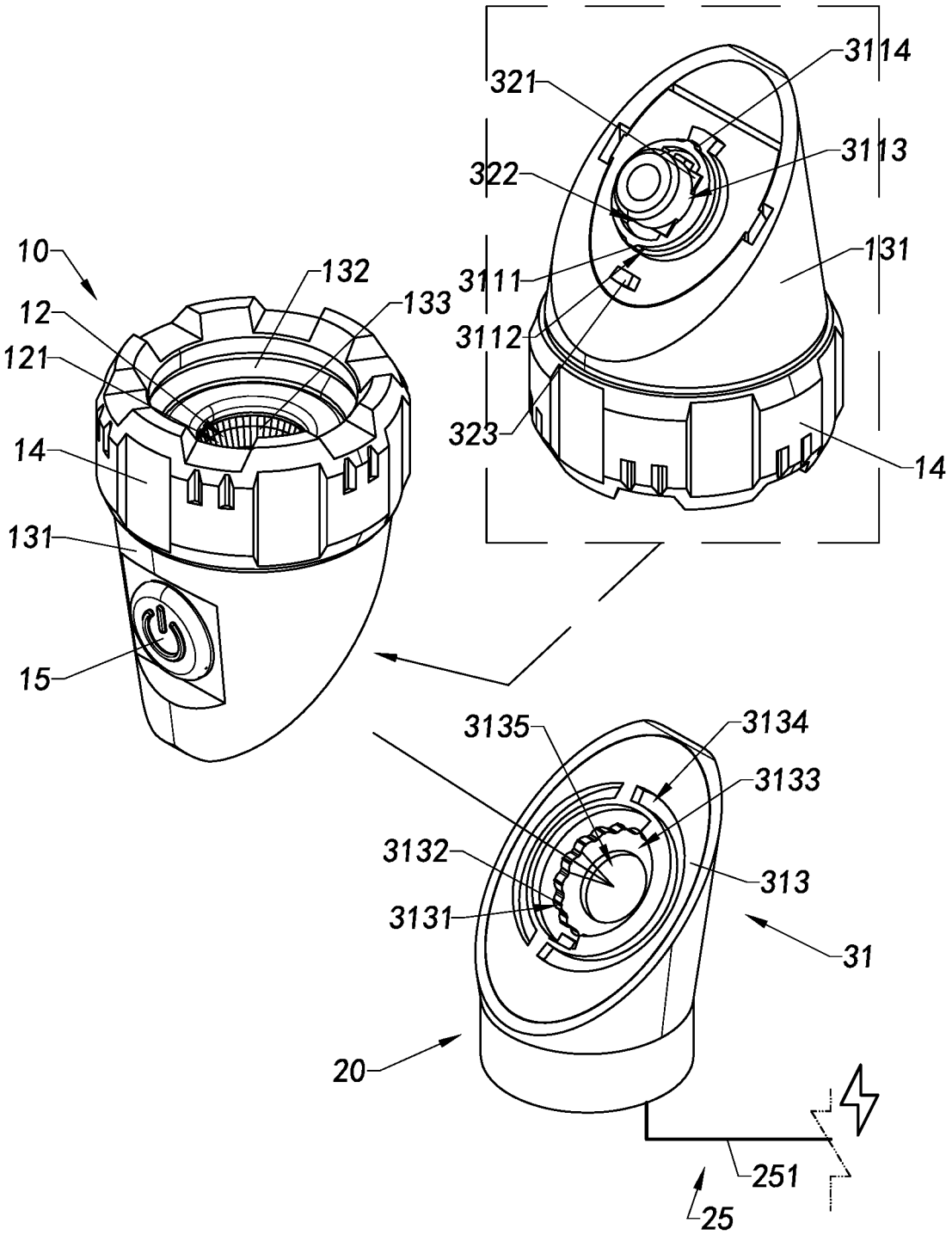
FIG. 5 is another perspective view of the lighting lamp according to the above first preferred embodiment of the present invention.
Figure 6A:
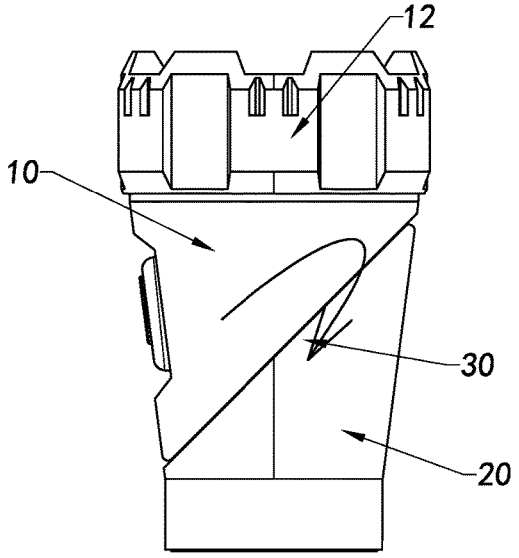
FIG. 6A to FIG. 6C illustrate the adjustment of illumination directions of the lighting lamp according to the above first preferred embodiment of the present invention.
Figure 6B:
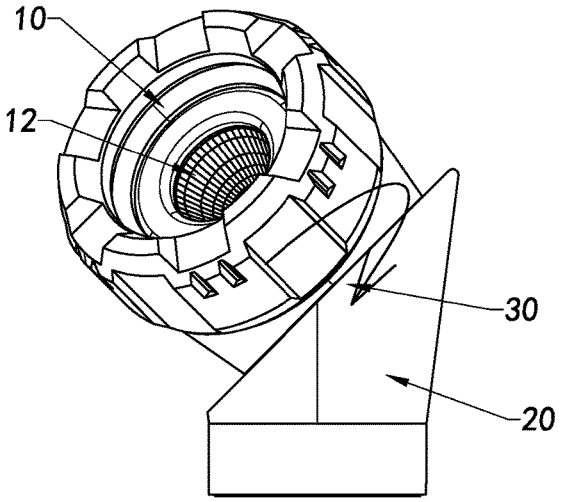
Figure 6C:
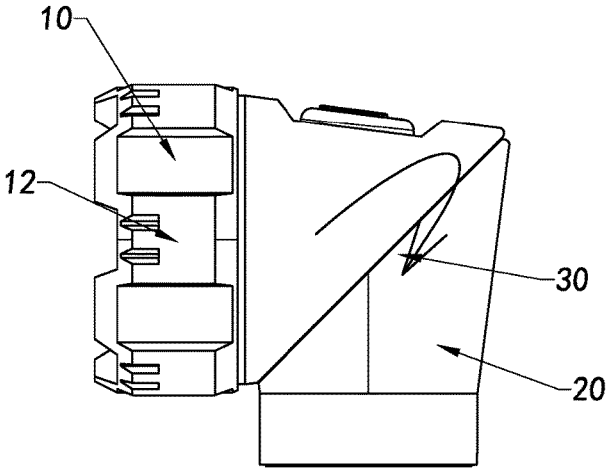
Figure 7:
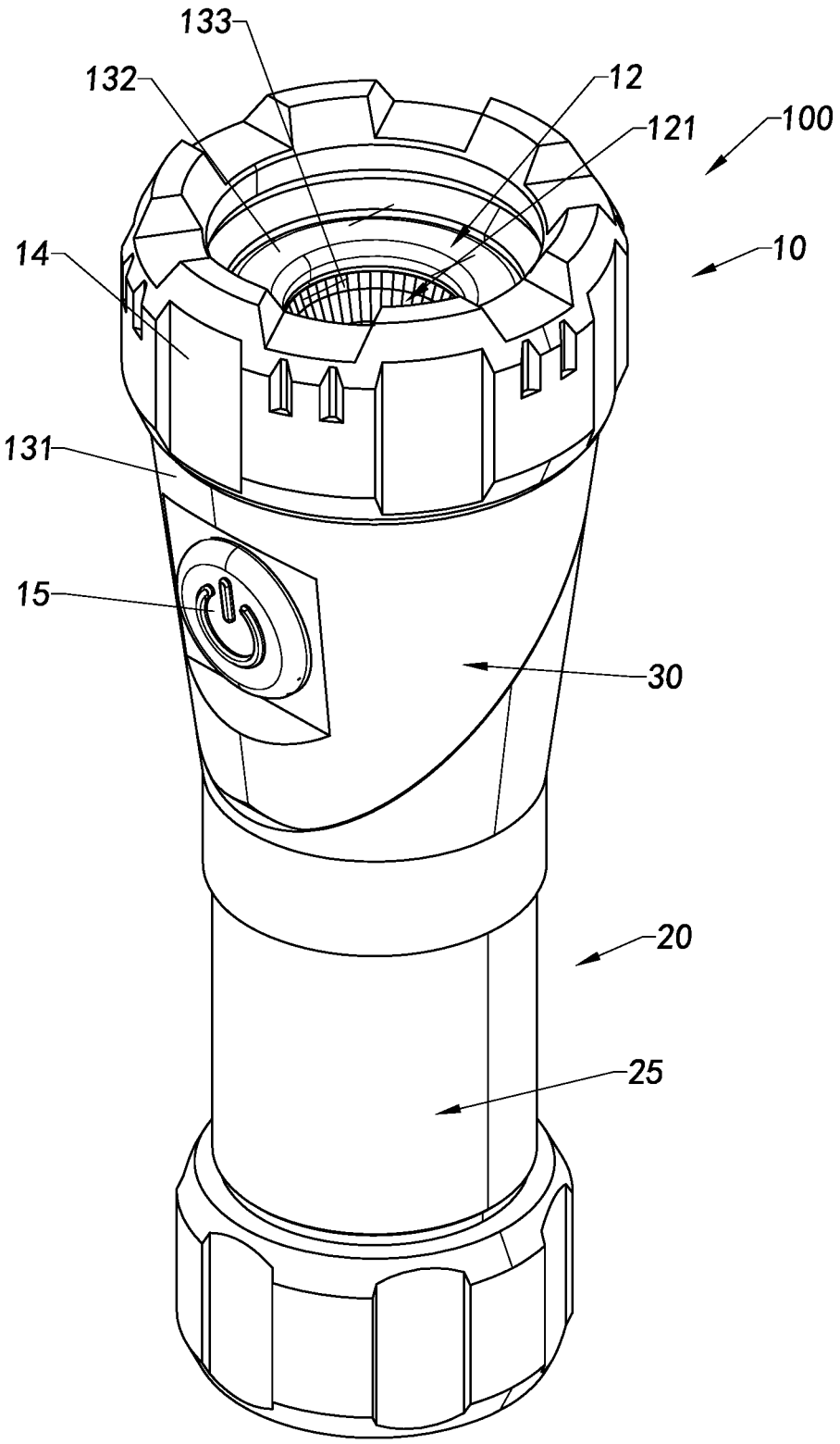
FIG. 7 is a perspective view of a lighting lamp according to a second preferred embodiment of the present invention.
Figure 8:
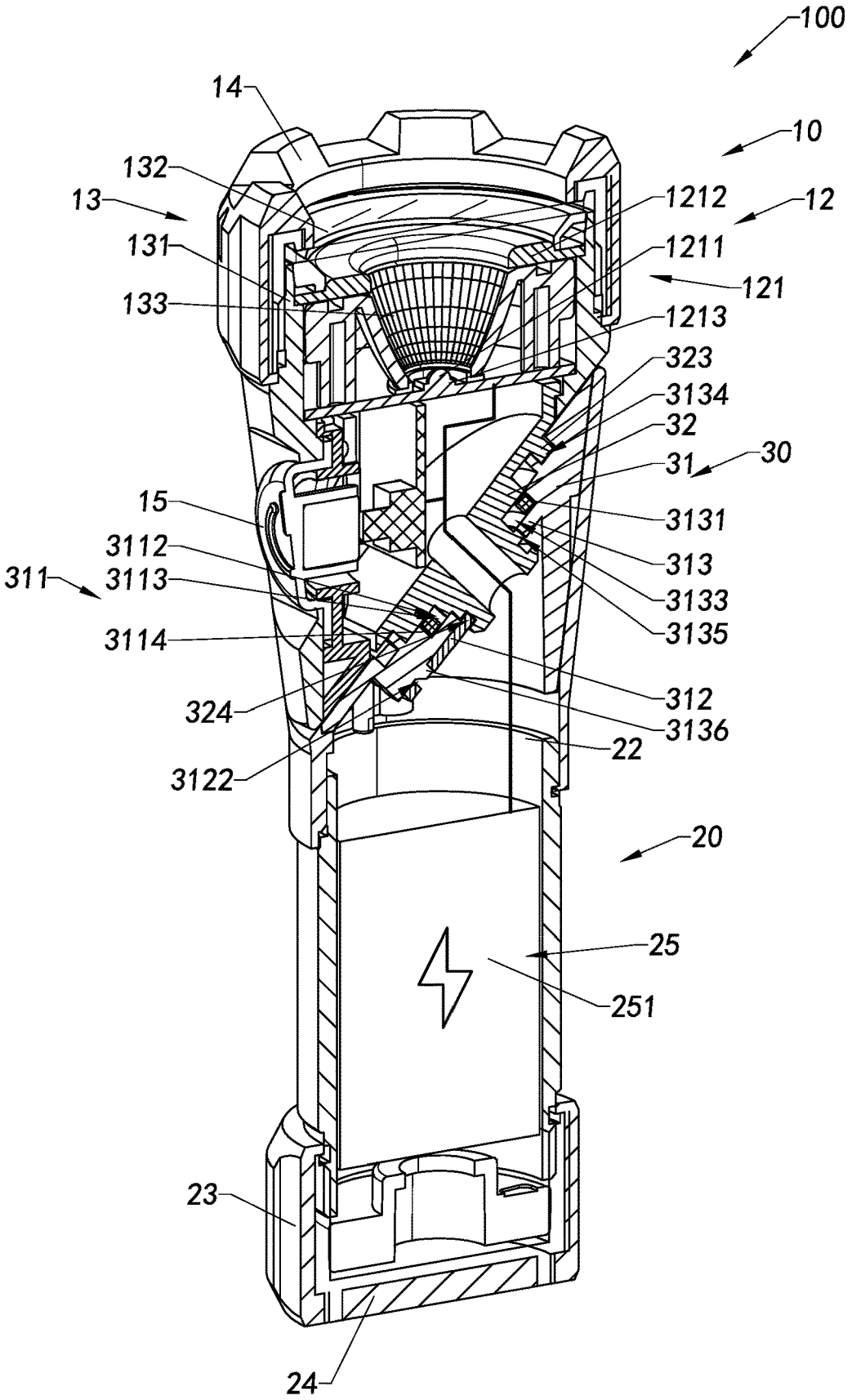
FIG. 8 is a sectional view of the lighting lamp according to the above second preferred embodiment of the present invention.
Figure 9:
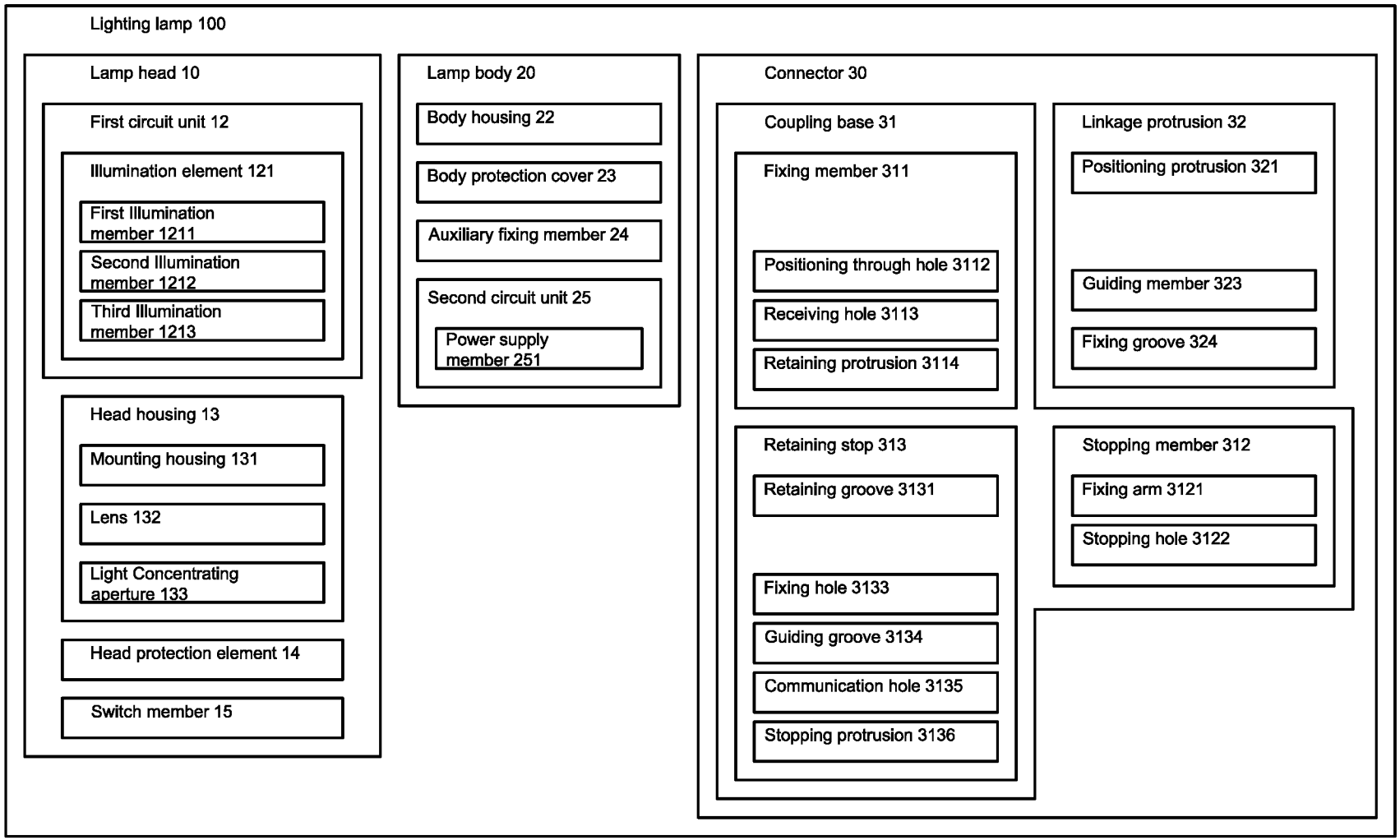
FIG. 9 is a block diagram illustrating the lighting lamp according to the above second preferred embodiment of the present invention.
Figure 10A:
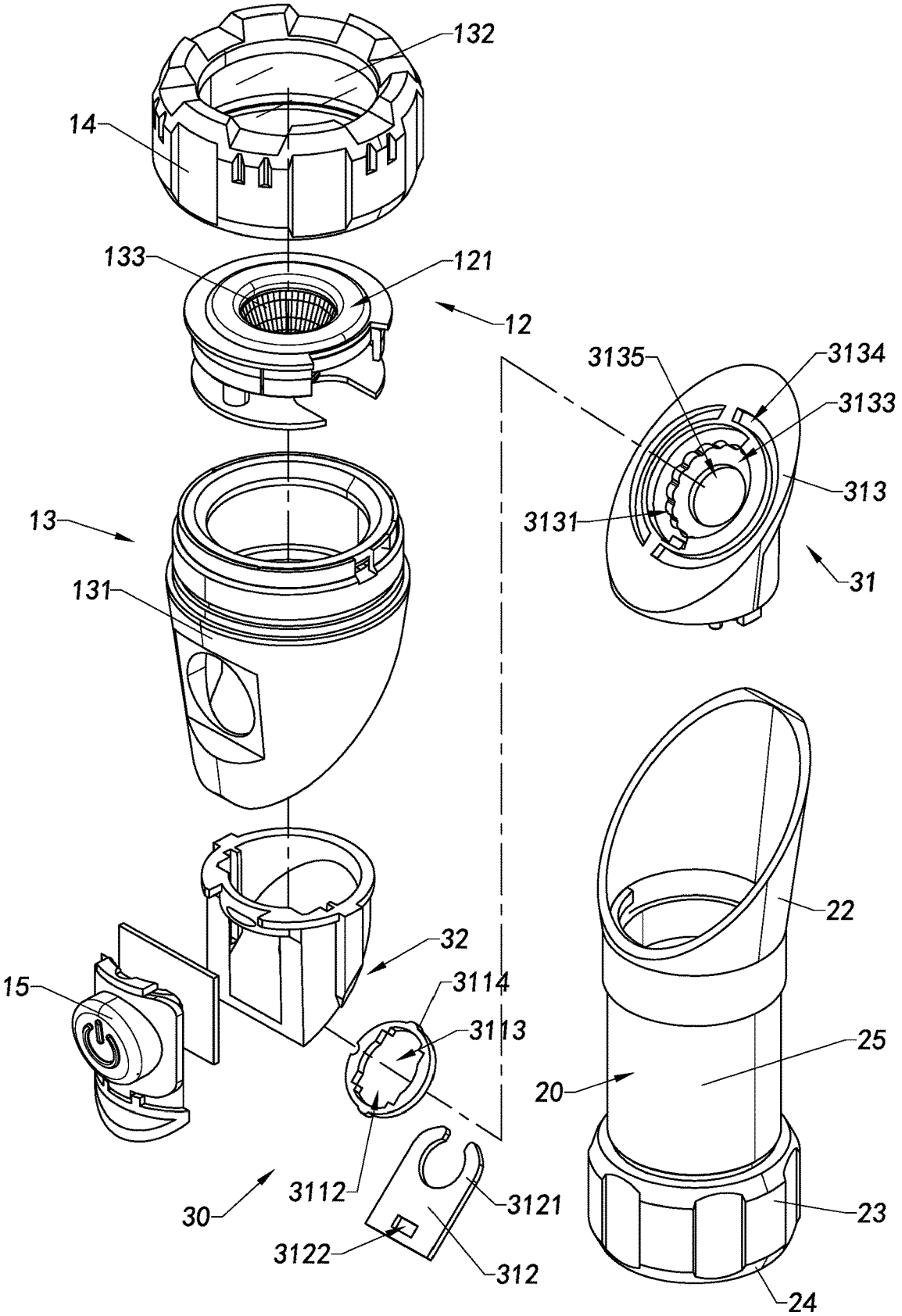
FIG. 10A is an exploded view from one viewing angle of the lighting lamp according to the above second preferred embodiment of the present invention.
Figure 10B:
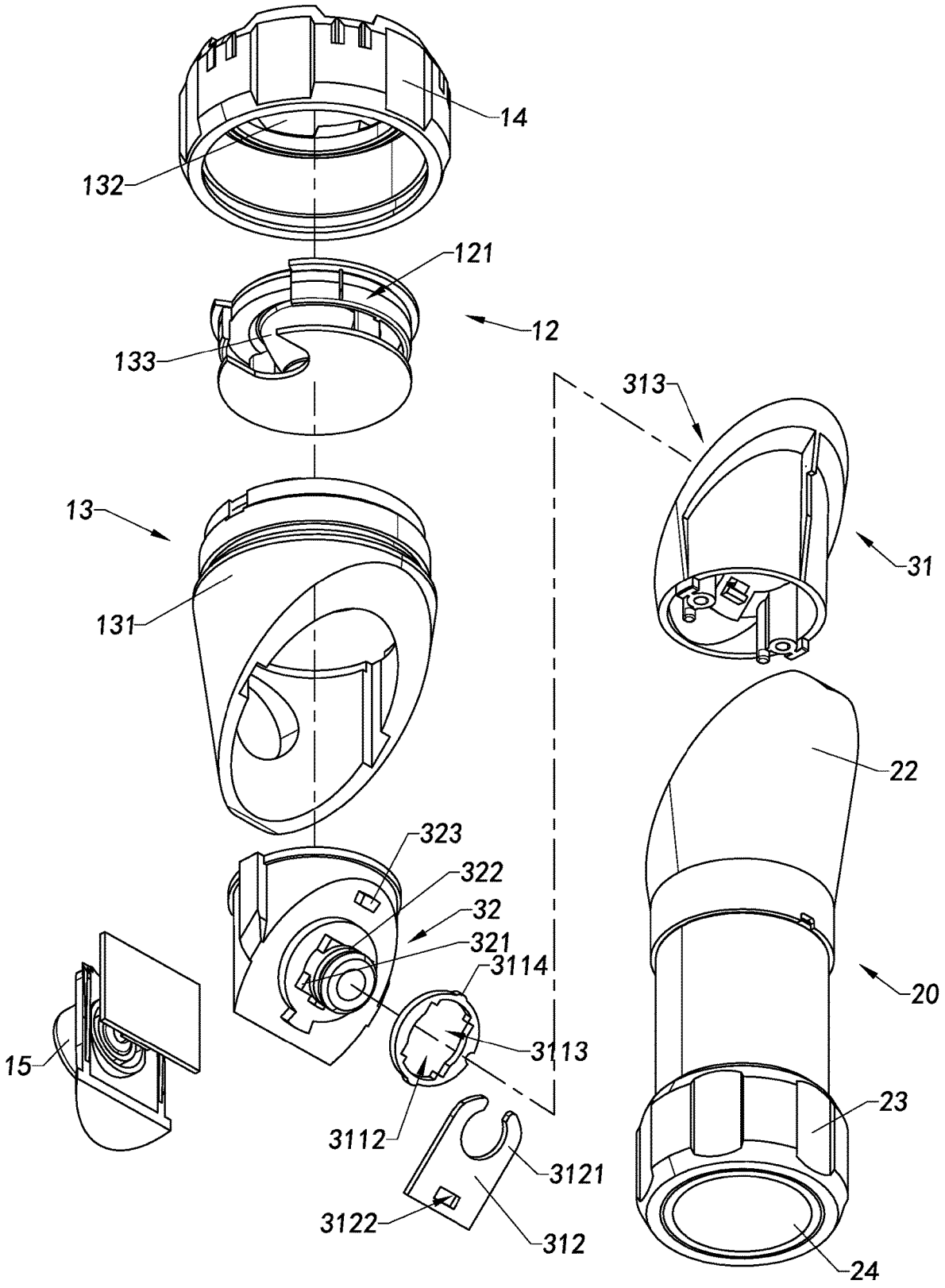
FIG. 10B is an exploded view from another viewing angle of the lighting lamp according to the above second preferred embodiment of the present invention.

Furthermore, as shown in FIG. 1 and FIG. 2, the connector 30 comprises a coupling base 31 and a linkage protrusion 32 detachably mounted on the coupling base 31. When the linkage protrusion 32 is detachably coupled to the coupling base 31, a relative movement between the linkage protrusion 32 and the coupling base 31 is liable. The coupling base 31 is fixedly mounted on the lamp body 20, or the coupling base 31 is integrally formed with a body housing 21 of the lamp body 20, and correspondingly, the linkage protrusion 32 is fixedly mounted to the lamp head 10, or the linkage protrusion 32 is integrally formed with a base housing 13 of the lamp head 10. In other words, when the linkage protrusion 32 and the coupling base 31 move relative to each other, the relative movement between the lamp head 10 and the lamp body 20 is caused, so that the lamp head 10 and the lamp holder 10 are provided with a plurality of connection angles, and thus a plurality of illumination directions is provided. In other words, by the relative movement between the coupling base 31 and the linkage protrusion 32, the light direction of the lamp 100 can be changed, so as to provide various illumination angles. In addition, the coupling base 30 further has an inclined supporting surface 33 between the lamp head 10 and the lamp body 20.

More specifically, the coupling base 31 further comprises a retaining stop 313 and a fixing member 311. The retaining stop 313 has a fixing hole 3133, and the fixing member 311 is placed in the fixing hole 3133. The fixing member 311 has the same shape as the fixing hole 3133. The retaining stop 313 further has a plurality of retaining grooves 3131, and the retaining grooves 3131 are adjacently formed on a hole wall around the fixing hole 3133. The fixing member 311 is provided with two retaining protrusions 3114, and the retaining protrusions 3114 are respectively placed in the fixing grooves 3131 when the fixing members 311 are placed in the fixing holes 3133. The retaining protrusions 3114 are preferably symmetrically disposed. When the retaining protrusions 3114 are driven by an external force, each of the retaining protrusions 3114 can be rotated in the fixing hole 3133 by the external force, and is switched to be retained at the corresponding retaining groove 3131. The specification of each retaining groove 3131 matches with the specification of each corresponding protrusion 3114, and is slightly larger than the retaining protrusion 3114. When the fixing member 311 is placed in the fixing hole 3133, each retaining protrusion 3114 can be disposed in the corresponding retaining groove 3131. When the retaining protrusion 3114 are rotated in the fixing hole 3133 by the external force, the retaining protrusions 3114 will be sequentially switched to adjacent retaining grooves 3131. It is worth mentioning that the retaining protrusions 3114 can be transferred from one of the retaining grooves 3131 to the other adjacent retaining groove 3131 only when driven by the external force, thereby avoiding the retaining protrusion 3114 to arbitrarily switch from one of the retaining grooves 3131 to another retaining groove 3131. The fixing member 311 can be rotated in the fixing hole 3133 in a clockwise direction or a counterclockwise direction by the external force.

The fixing member 311 has a positioning through hole 3112, and the retaining stop 313 has a communication hole 3135. When the fixing member 311 is placed in the fixing hole 3133, the communication hole 3135 and the fixing hole 3133 are communicated to each other, and the communication hole 3135 is fitted into the fixing hole 3133. The connection protrusion 32 is simultaneously placed in the communication hole 3135 and the fixing hole 3133 to detachably connect the lamp head 10 to the lamp body 20. The fixing member 311 is provided with at least one receiving hole 3113, and the receiving hole 3113 is in communication with the positioning through hole 3112. The linkage protrusion 32 comprises at least one positioning protrusion 321 which is placed in the receiving hole 3113 when the linkage protrusion 32 is movably coupled to the coupling base 31. The positioning protrusion 321 is polygonal, that is to say, the receiving hole 3113 is also polygonal. When the fixing member 311 is rotated by the external force in the fixing hole 3133, that is to say, when each of the retaining protrusions 3114 is switched to different fixing grooves 3131 due to the rotation of the fixing member 311, the fixing member 311 will rotate the positioning protrusion 321 to rotate, thereby driving the linkage protrusion 32 to rotate, so that the lamp head 10 is rotated, and the connection angle between the lamp head 10 and the lamp body 20 is changed accordingly. In other words, when the lamp head 10 is rotated by the external force, the fixing member 311 will also be driven to rotate under the action of the rotation of the positioning protrusion 321, so that the lamp head 10 and the lamp body 20 are rotated and a relative movement therebetween takes place, so as to change the connection angle between the lamp head 10 and the lamp body 20, and providing different directions of light through the illumination element 121.

While the relative movement between the lamp head 10 and the lamp body 20 occurs, each of the retaining protrusions 3114 will be sequentially placed in adjacent retaining grooves 3131 under action of the external force. In other words, under the cooperation of the retaining protrusions 3114 and the retaining grooves 3131, the relative movement between the lamp head 10 and the lamp body 20 is achieved in a segmented rotation manner by sequentially disposing the retaining protrusions 3114 into adjacent retaining grooves 3131, so as to provide a multi-angle connection between the lamp head 10 and the lamp body 20, and thus the illumination element 121 provides multiple angles of illumination light.

A surface of the linkage protrusion 32 is provided with two opposite third electrical conductive members 322, and the retaining protrusions 3114 of the fixing member 311 are respectively provided with first electrical conductive members 3111, when the linkage protrusion 32 is placed in the positioning through hole 3112, the third electric conductive member 322 is in contact with the first electric conductive member 3132. A second electrical conductive member 3132 is disposed on a groove wall around each of the retaining grooves 3131. When the fixing member 311 is disposed in the fixing hole 3133, each of the first electric conductive members 3111 is in contact with one of the corresponding second electrical conductive members 3132. In other words, when the linkage protrusion 32 is simultaneously placed in the fixing hole 3133 and the positioning through hole 3112, each of the first electric conductive members 3111 is simultaneously in contact with one of the second electrical conductive members 3132 and one third electrical conductive members 322. Accordingly, the third electric conductive member 322 is electrically coupled to the first circuit unit 12, and the second electrical conductive member 3132 is electrically coupled to the second circuit unit 25, and when each of the first electric conductive members 3111 is simultaneously in contact with one of the second electrical conductive members 3132 and one third electrical conductive members 322, the first circuit unit 12 and the second circuit unit 25 are connected to form the complete circuit. The second circuit unit 25 includes a power supply member 251, and the power supply member 251 can supply electric energy to the illumination element 121 to provide illumination when the first circuit unit 12 and the second circuit unit 25 are connected. In other words, as the lamp head 10 and the lamp body 20 are connected to each other by the connector 30, the first circuit unit 12 and the second circuit unit 25 are connected through the switch member 15, the power supply member 251 is capable of providing electrical energy to the illumination element 121 for illumination.

It is worth mentioning that the energy supply member 251 is preferably a power storage device such as, but not limited to, a power storage battery, a solar battery, a fuel battery, or the like.

It is worth mentioning that when the switch member 15 is in the closed state, the illumination element 121 can immediately provide illumination when the lamp head 10 and the lamp body 20 are connected to each other. In other words, if the switch member 15 is in the closed state, when the lamp head 10 and the lamp body 20 are connected, the first circuit unit 12 and the second circuit unit 25 are electrically connected, the illumination element 121 is illuminated to provide a light illumination; when the lamp head 10 and the lamp body 20 are separated from each other, the first circuit unit 12 and the second circuit unit 25 are disconnected, and the illumination element 121 will not be able to provide lighting. When the switch member 15 is in an open state, if it is required to provide illumination through the illumination element 121, the lamp head 10 and the lamp body 20 need to be connected, and the switching element 252 is required to be in a closed state, so as to electrically couple the first circuit unit 12 and the second circuit. In other words, the light lamp 100 is a dual switch arrangement, and only when the first circuit unit 12 and the second circuit unit 25 are connected, and the switching element 252 is in a closed state, the first circuit unit 12 and the second circuit unit 25 are electrically connected, so that the power supply member 251 is then able to supply power to the illumination element 121 for proving light illumination, thereby allowing the user to perform a setting operation on the lighting lamp 100 depending on the usage situation. For example, after the switch member 15 is closed, the lamp head 10 and the lamp body 20 are connected, so that the illumination element 121 can be illuminated at the moment when the lamp head 10 and the lamp body 20 are connected. When the lamp head 10 is connected to the lamp body 20 first and then the switch member 15 is closed, the illumination element 121 will be illuminated after the switch member 15 is closed.

The retaining stop 313 further has at least one guiding groove 3134. The linkage protrusion 32 further includes at least one guiding member 323. When the lamp head 10 is detachably connected to the lamp body 20, the guiding member 323 is placed in the guiding groove 3134, and when the lamp head 10 and the lamp body 20 move relative to each other, the guiding member 323 moves along the guiding groove 3134, thereby restricting a trajectory of the relative motion of the lamp head 10 with respect to the lamp body 20. The fixing member 311 is capable of being rotated clockwise or counterclockwise in the fixing hole 3133 by an external force. In other words, when relative movement occurs between the lamp head 10 and the lamp body 20, the lamp head 10 and the lamp body 20 are rotated relatively clockwise or counterclockwise. When a relative clockwise or counterclockwise rotation occurs between the lamp head 10 and the lamp body 20, the guiding member 323 will rotate along the guiding groove 3134 in a clockwise or counterclockwise manner. In other words, it is said that the guiding groove 3134 has a circular arc shape or a circular shape. When the lighting lamp 100 is switched from the first illumination state to the second illumination state or from the second illumination state to the first illumination state, the lamp head 10 is rotated by 180 degrees with respect to the retaining stop 313, as shown in the FIGS. 6A to 6C.

When the relative movement between the lamp head 10 and the lamp body 20 takes place, the lamp head 10 and the lamp body 20 are rotated 180 degrees with respect to the connecting surface thereof, so that the connection angle between the amp head 10 and the lamp body 20 has a change ranged from 0 to 90 degrees. The connection angle between the lamp head 10 and the lamp body 20 is between 180 degrees and 90 degrees. When the connection angle between the lamp head 10 and the lamp body 20 is 180 degrees, the lighting lamp 100 is in the first illumination state. At this time, the illumination element 121 is provided with illumination light that is consistent with the extending direction of the lamp body 20. When the connection angle between the lamp head 10 and the lamp body 20 is 90 degrees, the lighting lamp 100 is in the second illumination state, the illumination element 121 is provided with illumination light perpendicular to the extending direction of the lamp body 20. When the lamp head 10 and the lamp body 20 define an obtuse angle, i.e. between 90 degrees and 180 degrees, the illuminating device 100 is in the third illumination state. It should be noted that regardless of the connection angle between the lamp head 10 and the lamp body 20, the center of gravity of the lamp 100 is always located at the lamp body 20, and therefore, the lighting lamp 100 is erected on a placement plane. When the lighting lamp 100 is in the first illumination state or the second illumination state, the lighting lamp 100 can be independently and stably placed on the placement plane without the aid of an auxiliary tool. When the lighting lamp 100 is in the first illumination state, the light emitted by the illumination element 121 is perpendicular to the placement plane, when the lighting lamp 100 is in the second illumination state, the direction of light emitted by the illumination element 121 is parallel with the placement plane.

The lamp head 10 further comprises a head protection element 14 that is detachably mounted to one end of the head housing 13. The head protection element 14 is preferably made of an elastic material, such as rubber or silica gel, so as to protect the lamp head 10 from damage when an external force is applied at one end of the lamp head 10. The head housing 13 further comprises a mounting housing 131, a lens 132 and a light concentrating aperture 133, the first circuit unit 12, the lens 132 and the light concentrating aperture 133 are all disposed in the mounting housing 131. The head protection element 14 is mounted to one end of the mounting housing 131, and the linkage protrusion 32 of the connector 30 is mounted and fixed to the other end of the mounting housing 13. The illumination element 121 is disposed at a center of the light concentrating aperture 133 and surrounded by the light concentrating aperture 133 to collect the light emitted by the illumination element 121 and control the direction of light emitted by the illumination element 121. The lens 132 is placed at the other end of the mounting housing 131 to close the other end of the mounting housing 131 while protecting various circuit components of the first circuit unit 12 as well as the illumination element 121.

It is to be noteworthy that, in the preferred embodiment, the illumination element 121 further comprises at least one first illumination member 1211, at least one second illumination member 1212, and at least one third illumination member 1213, wherein the first illumination member 1211, the second illumination member 1212, and the third illumination member 1213 respectively provide illumination light of different characteristics, including different light intensity and different light divergence angles. The first illumination member 1211, the second illumination member 1212 and the third illumination member 1213 are respectively connected into the electric pathway formed by the first circuit unit 12 and the second circuit unit 25, so as to provide different lighting characteristics for use.

The lamp body 20 further includes a body housing 22 and an auxiliary fixing member 24 mounted at one end of the body housing 22, and the second circuit unit 25 is disposed in an inner cavity of the body housing 22. The auxiliary fixing member 24 is used to assist the lighting lamp 100 for fixing to other objects. Specifically, in the first preferred embodiment, the auxiliary fixing member 24 is a magnetic member having magnetically attracting ability, and is disposed at one end of the body housing 22, and the auxiliary fixing member 24 is magnetically attracted to iron and an alloy containing iron, so that the auxiliary fixture 24 can be fixed to a surface made of iron or an alloy of iron. For example, with the help of the auxiliary fixing member 24, the lighting lamp 100 can be mounted to a body of a transportation tool, i.g. the lighting lamp can be fixed at a surface of a bicycle, or a car which includes a ferrous material, so that it is convenient to fix the lighting lamp 100 at various angles and provide a variety of illumination directions by the various connection angles between the lamp head 10 and the lamp body 20. In addition, the auxiliary fixing member 24 can also be attracted by other objects having magnetic attracting ability, such as a magnet having an opposite magnetic pole.

The lamp body 20 further comprises a body protection cover 23 connected to one end of the lamp body 20, and the other end of the lamp body is mounted with the coupling base 31. The body cover 23 is preferably made of an elastic material such as rubber or silicone to protect the lamp body 20 from damage when an external force is applied to the one end of the lamp body 20.

Preferably, the switch member 15 is disposed on the head housing 13 and is embedded into the mounting housing 131 to reduce the probability of accidental contact with the switch member 15.

Preferably, a surface of the lamp body 20 is further provided with an anti-slip line pattern to increase the friction coefficient of the surface of the lamp body 20 to preventing slipping and enhance the feeling during usage.

Referring to FIG. 7 to FIG. 10B of the drawings of the present invention, a lighting lamp 100 in accordance with a second preferred embodiment of the present invention is disclosed and illustrated in the following description. The lighting lamp 100 comprises a lamp head 10, a lamp body 20 and a connector 30, the lamp head 10 is adjustably disposed on the lamp body 20 through the connector 30. The lamp head 10 is provided with at least one illumination element 121 and a switch member 15. The lamp body 20 comprises a power supply member 251, and when the lamp head 10 is detachably connected to the lamp body 20 through the connector 30, and the switch member 15 is in a closed state, the power supply member 251 is capable of supplying electrical energy to the illumination element 121 to cause it to illuminate.

It is worth mentioning that the lamp head 10 and the lamp body 20 can be relatively moved under the action of the connector 30. When the lamp head 10 and the lamp body 20 are in the same extending direction, the lamp 100 is in a first illumination state, the illumination element 121 provides illumination light that is consistent with the extending direction of the lamp head 10 and the lamp body 20. When the extending direction of the lamp head 10 and the extension direction of the lamp body 20 are perpendicular to each other under the action of the connector 30, the illumination element 121 is provided with illumination light perpendicular to the direction in which the lamp body 20 extends. That is to say, when the lamp body 100 is in the second illumination state, the extending direction of the lamp head 10 and the extending direction of the lamp body 20 are perpendicular to each other.

Preferably, under the action of the connector 30, the connection angle between the lamp head 10 and the lamp body 20 is changed at various angles between 90 degrees and 180 degrees, that is to say, the extending directions of the lamp head 10 and the lamp body 20 define at least two angles, thereby providing a plurality of illumination directions by the illumination element 121.

The lamp head 10 includes a head housing 13, a first circuit unit 12 and a switch member 15. The first circuit unit 12 is disposed in the head housing 13, and the switch member 15 is provided to the first circuit unit 12, the illumination element 121 is electrically coupled to the first circuit unit 12. The lamp body 20 comprises a body housing 22 and a second circuit unit 25 disposed in the body housing 22. When the lamp head 10 is connected to the lamp body 20 through the connector 30, the first circuit unit 12 and the second circuit unit 25 can form a complete circuit. In other words, when the lamp head 10 and the lamp body 20 are connected to each other through the connector 30, if the switch member 15 is closed, the complete circuit formed by the first circuit unit 12 and the second circuit unit 25 is electrically connected, and the illumination element 121 is illuminating to provide illumination light; and if the switching element 15 is disconnected, the complete circuit formed by the first circuit unit 12 and the second circuit unit 25 will be disconnected to form an open circuit, and the illumination element 121 will not be able to illuminate to provide illumination light.

The lamp head 10 and the lamp body 20 are relatively moved under the action of the connector 30, so that the lighting lamp 100 can be shifted between different illumination states. When the angle between the lamp head 10 and the lamp body 20 is 180 degrees, the lighting lamp 100 is in the first illumination state, and when the angle between the connection between the lamp head 10 and the lamp body 20 is 90 degrees, the lighting lamp 100 is in the second illumination state. When the lighting lamp 100 is in the first illumination state, the illumination element 121 provides an illumination direction that is consistent with the direction in which the lamp body 20 extends; when the lighting lamp 100 is in the second illumination state, the illumination element 121 provides an illumination direction that is perpendicular to the extending direction of the lamp body 20.

It is worth mentioning that when the lighting lamp 100 is in the third illumination state, the lamp head 10 and the lamp body 20 can be maintained at a plurality of connection angles, and the illumination element 121 is provided with and maintained at a plurality of illumination angles.

More specifically, the connector 30 comprises a coupling base 31 and a linkage protrusion 32 detachably mounted on the coupling base 31. When the linkage protrusion 32 is detachably coupled to the coupling base 31, a relative movement between the linkage protrusion 32 and the coupling base 31 is liable. The coupling base 31 is fixedly mounted on the lamp body 20, the linkage protrusion 32 is fixedly mounted to the lamp head 10. In other words, when the linkage protrusion 32 and the coupling base 31 move relative to each other, the relative movement between the lamp head 10 and the lamp body 20 is caused, so that the lamp head 10 and the lamp holder 10 are provided with a plurality of connection angles, and thus a plurality of illumination directions is provided. In other words, by the relative movement between the coupling base 31 and the linkage protrusion 32, the light direction of the lamp 100 can be changed, so as to provide various illumination angles.

The second circuit unit 25 comprises the power supply member 251. The lamp head 10 comprises the switch member 15. When the switch member 15 is in a closed state, the first circuit unit 12 and the second circuit unit 25 are electrically connected, at this time, the power supply member 251 is capable of supplying electric power to the illumination element 121 for light illumination. The power supply member 251 is preferably an electrical storage device, such as a storage battery, a solar battery, and a fuel battery.

The coupling base 31 further comprises a retaining stop 313 and a fixing member 311. The retaining stop 313 has a fixing hole 3133, and the fixing member 311 is placed in the fixing hole 3133. The fixing member 311 has the same shape as the fixing hole 3133. The retaining stop 313 further has a plurality of retaining grooves 3131, and the retaining grooves 3131 are adjacently formed on a hole wall around the fixing hole 3133. The fixing member 311 is provided with at least two retaining protrusions 3114, and the retaining protrusions 3114 are respectively placed in the fixing grooves 3131 when the fixing members 311 are placed in the fixing holes 3133.

The fixing member 311 has a positioning through hole 3112, and the retaining stop 313 has a communication hole 3135. When the fixing member 311 is placed in the fixing hole 3133, the connection protrusion 32 is simultaneously placed in the communication hole 3135 and the positioning through hole 3112

According to this second preferred embodiment, the retaining protrusions 3114 are preferably symmetrically disposed, and the retaining grooves 3131 are adjacently formed on a hole wall around the fixing hole 3133. The retaining protrusions 3114 can be rotated in the fixing hole 3133 by the external force. The specification of each retaining groove 3131 is slightly larger than the specification of each corresponding protrusion 3114, when the fixing member 311 is placed in the fixing hole 3133, each retaining protrusion 3114 can be disposed in the corresponding retaining groove 3131. When the retaining protrusion 3114 are rotated in the fixing hole 3133 by the external force, the retaining protrusions 3114 will be sequentially switched to adjacent retaining grooves 3131. It is worth mentioning that the retaining protrusions 3114 can be transferred from one of the retaining grooves 3131 to the other adjacent retaining groove 3131 only when driven by the external force, thereby avoiding the retaining protrusion 3114 to arbitrarily switch from one of the retaining grooves 3131 to another retaining groove 3131. The fixing member 311 can be rotated in the fixing hole 3133 in a clockwise direction or a counterclockwise direction by the external force.

The fixing member 311 is provided with at least one receiving hole 3113, and the receiving hole 3113 is in communication with the positioning through hole 3112. The linkage protrusion 32 comprises at least one positioning protrusion 321 which can be placed in the receiving hole 3113 when the linkage protrusion 32 is simultaneously placed in the communication hole 3135 and the positioning through hole 3112. The positioning protrusion 321 is polygonal, that is to say, the receiving hole 3113 is also polygonal. When the fixing member 311 is rotated by the external force in the fixing hole 3133, that is to say, when each of the retaining protrusions 3114 is switched to different fixing grooves 3131 due to the rotation of the fixing member 311, the fixing member 311 will rotate the positioning protrusion 321 to rotate, thereby driving the linkage protrusion 32 to rotate, so that the lamp head 10 is rotated, and the connection angle between the lamp head 10 and the lamp body 20 is changed accordingly. In other words, when the lamp head 10 is rotated by the external force, the fixing member 311 will also be driven to rotate under the action of the rotation of the positioning protrusion 321, so that the lamp head 10 and the lamp body 20 are rotated and a relative movement therebetweem takes place, so as to change the connection angle between the lamp head 10 and the lamp body 20, and providing different directions of light through the illumination element 121.

While the relative movement between the lamp head 10 and the lamp body 20 occurs, each of the retaining protrusions 3114 will be sequentially placed in adjacent retaining grooves 3131 under action of the external force. In other words, under the cooperation of the retaining protrusions 3114 and the retaining grooves 3131, the relative movement between the lamp head 10 and the lamp body 20 is achieved in a segmented rotation manner by sequentially disposing the retaining protrusions 3114 into adjacent retaining grooves 3131, so as to provide a multi-angle connection between the lamp head 10 and the lamp body 20, and thus the illumination element 121 provides multiple angles of illumination light.

The retaining stop 313 further has at least one guiding groove 3134. The linkage protrusion 32 further includes at least one guiding member 323. When the lamp head 10 is detachably connected to the lamp body 20, the guiding member 323 is placed in the guiding groove 3134, and when the lamp head 10 and the lamp body 20 move relative to each other, the guiding member 323 moves along the guiding groove 3134, thereby restricting a trajectory of the relative motion of the lamp head 10 with respect to the lamp body 20. The fixing member 311 is capable of being rotated clockwise or counterclockwise in the fixing hole 3133 by an external force. In other words, when relative movement occurs between the lamp head 10 and the lamp body 20, the lamp head 10 and the lamp body 20 are rotated relatively clockwise or counterclockwise. When a relative clockwise or counterclockwise rotation occurs between the lamp head 10 and the lamp body 20, the guiding member 323 will rotate along the guiding groove 3134 in a clockwise or counterclockwise manner. In other words, it is said that the guiding groove 3134 has a circular arc shape or a circular shape.

A connecting surface between the lamp head 10 and the lamp body 20 has a smooth planar design, and the lamp head 10 and the lamp body 20 can be rotated 180 degrees with respect to the connecting surface thereof. The connection angle between the lamp head 10 and the lamp body 20 is arranged between 180 degrees and 90 degrees. When the connection angle between the lamp head 10 and the lamp body 20 is 180 degrees, the illumination lamp 100 is in a first illumination state; when the connection angle between the lamp head 10 and the lamp body 20 is 90 degrees, the illumination lamp 100 is in a second illumination state; when the lamp head 10 and the lamp body 20 define an obtuse angle, i.e. between 90 degrees to 180 degrees, the illumination lamp 100 is in a third illumination state, when the illumination lamp 100 is in the first illumination state, the illumination element 121 is provided with a light direction that is consistent with the extending direction of the lamp body 20, and when the illumination lamp 100 is in the second illumination state, the illumination The element 121 is provided with a light direction perpendicular to the extending direction of the lamp body 20. It is worth mentioning that, regardless of the connection angle between the lamp head 10 and the lamp body 20, the center of gravity of the lamp 100 is always located a the lamp body 20. Therefore, when the lamp 100 is placed on a placement plane, regardless of the illumination lamp 100 is in the first illumination state, the second illumination state, or the third illumination state, the illumination lamp 100 can be independently and stably placed on the placement plane without the aid of an auxiliary tool. When the illumination lamp 100 is in the first illumination state, the light emitted by the illumination element 121 is perpendicular to the placement plane; when the illumination lamp 100 is in the second illumination state, the illumination direction of the illumination element 121 is parallel to the placement plane.

When the illumination lamp 100 is switched from the first illumination state to the second illumination state, or from the second illumination state to the first illumination state, the lamp head 10 is rotated 180 degrees with respect to the retaining stop 313.

The coupling base 31 further comprises a stopping member 312 comprising a fixing arm 3112 and at least one stopping hole 3122. The linkage protrusion 32 has a fixing groove 324, and the linkage protrusion 32 is clamped to the fixing arm 3121. When the linkage protrusion 32 is clamped to the fixing arm 3121. The fixing arm 3121 is placed in the fixing groove 324 to restrict the linkage protrusion 32 from being removed from the fixing arm 3121. The retaining stop 313 is provided with at least one stopping protrusion 3136, the stopping hole 3122 and the fixing arm 3121 are respectively formed at two ends of the stopping member 312. When the linkage protrusion 32 is clamped by the fixing arm 3121, the stopping protrusion 3136 is placed in the stopping hole 3122 to fix the other end of the stopping member 312. In other words, by placing the stopping projection 3136 in the stopping hole 3122, one end of the stopper 312 is restricted, and the fixing arm 3121 is restricted by the fixing groove 324, thereby restricting the movement of the linkage protrusion 32 and fixing the linkage protrusion 32 to the fixing hole 3133 and the communication hole 3135, so as to connect the lamp head 10 to the lamp body 20. The stopping member 312 is placed in the fixing hole 3133 and supported by a bottom wall at a bottom of the fixing hole 3133.

The lamp head 10 further comprises a head protection element 14 that is detachably mounted to one end of the head housing 13. The head protection element 14 is preferably made of an elastic material, such as rubber or silica gel, so as to protect the lamp head 10 from damage when an external force is applied at one end of the lamp head 10. The head housing 13 further comprises a mounting housing 131, a lens 132 and a light concentrating aperture 133, the first circuit unit 12, the lens 132 and the light concentrating aperture 133 are all disposed in the mounting housing 131. The head protection element 14 is mounted to one end of the mounting housing 131, and the linkage protrusion 32 of the connector 30 is mounted and fixed to the other end of the mounting housing 13. The illumination element 121 is disposed at a center of the light concentrating aperture 133 and surrounded by the light concentrating aperture 133 to collect the light emitted by the illumination element 121 and control the direction of light emitted by the illumination element 121. The lens 132 is placed at the other end of the mounting housing 131 to close the other end of the mounting housing 131 while protecting various circuit components of the first circuit unit 12 as well as the illumination element 121.

It is to be noteworthy that, in the preferred embodiment, the illumination element 121 further comprises at least one first illumination member 1211, at least one second illumination member 1212, and at least one third illumination member 1213, wherein the first illumination member 1211, the second illumination member 1212, and the third illumination member 1213 respectively provide illumination light of different characteristics, including different light intensity and different light divergence angles. The first illumination member 1211, the second illumination member 1212 and the third illumination member 1213 are respectively connected into the electric pathway formed by the first circuit unit 12 and the second circuit unit 25, so as to provide different lighting characteristics for use.

The lamp body 20 further includes a body housing 22 and an auxiliary fixing member 24 mounted at one end of the body housing 22, and the second circuit unit 25 is disposed in an inner cavity of the body housing 22. The auxiliary fixing member 24 can be magnetically attracted to iron and an alloy containing iron, so that the auxiliary fixture 24 can be fixed to a surface made of iron or an alloy of iron. For example, with the help of the auxiliary fixing member 24, the lighting lamp 100 can be mounted to a body of a transportation tool, so that it is convenient to fix the lighting lamp 100 at various angles and provide a variety of illumination directions by the various connection angles between the lamp head 10 and the lamp body 20. In addition, the auxiliary fixing member 24 can also be attracted by other objects having magnetic force, such as a magnet having an opposite magnetic pole.

The lamp body 20 further comprises a body protection cover 23 connected to one end of the lamp body 20, and the other end of the lamp body is mounted with the coupling base 31. The body cover 23 is preferably made of an elastic material such as rubber or silicone to protect the lamp body 20 from damage when an external force is applied to the one end of the lamp body 20.

Preferably, the switch member 15 is disposed on the head housing 13 and is embedded into the mounting housing 131 to reduce the probability of accidental contact with the switch member 15.

Preferably, a surface of the lamp body 20 is further provided with an anti-slip line pattern to increase the friction coefficient of the surface of the lamp body 20 to preventing slipping and enhance the feeling during usage.

Figure 11:
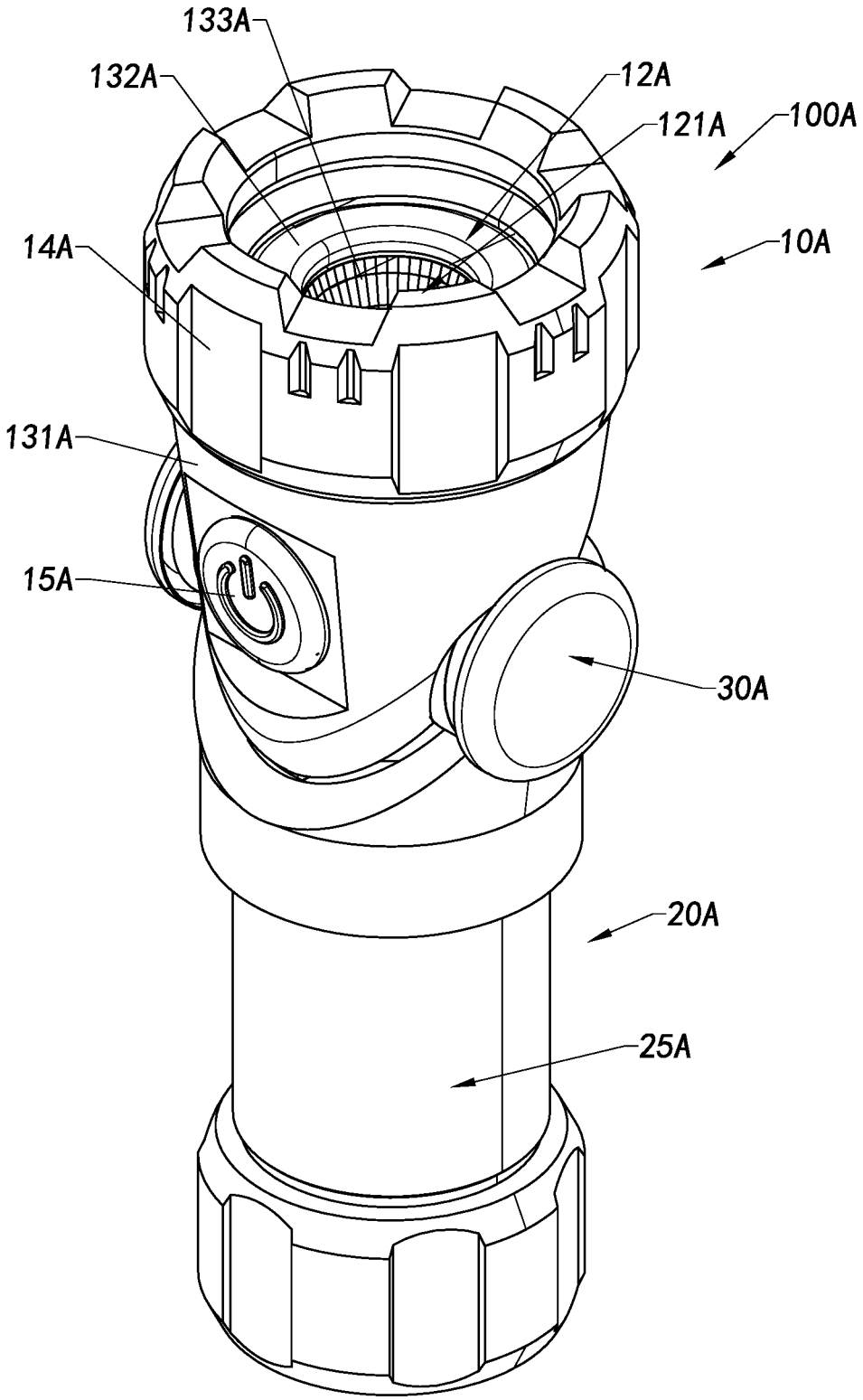
FIG. 11 is a perspective view of a lighting lamp according to a third preferred embodiment of the present invention.
Figure 12:
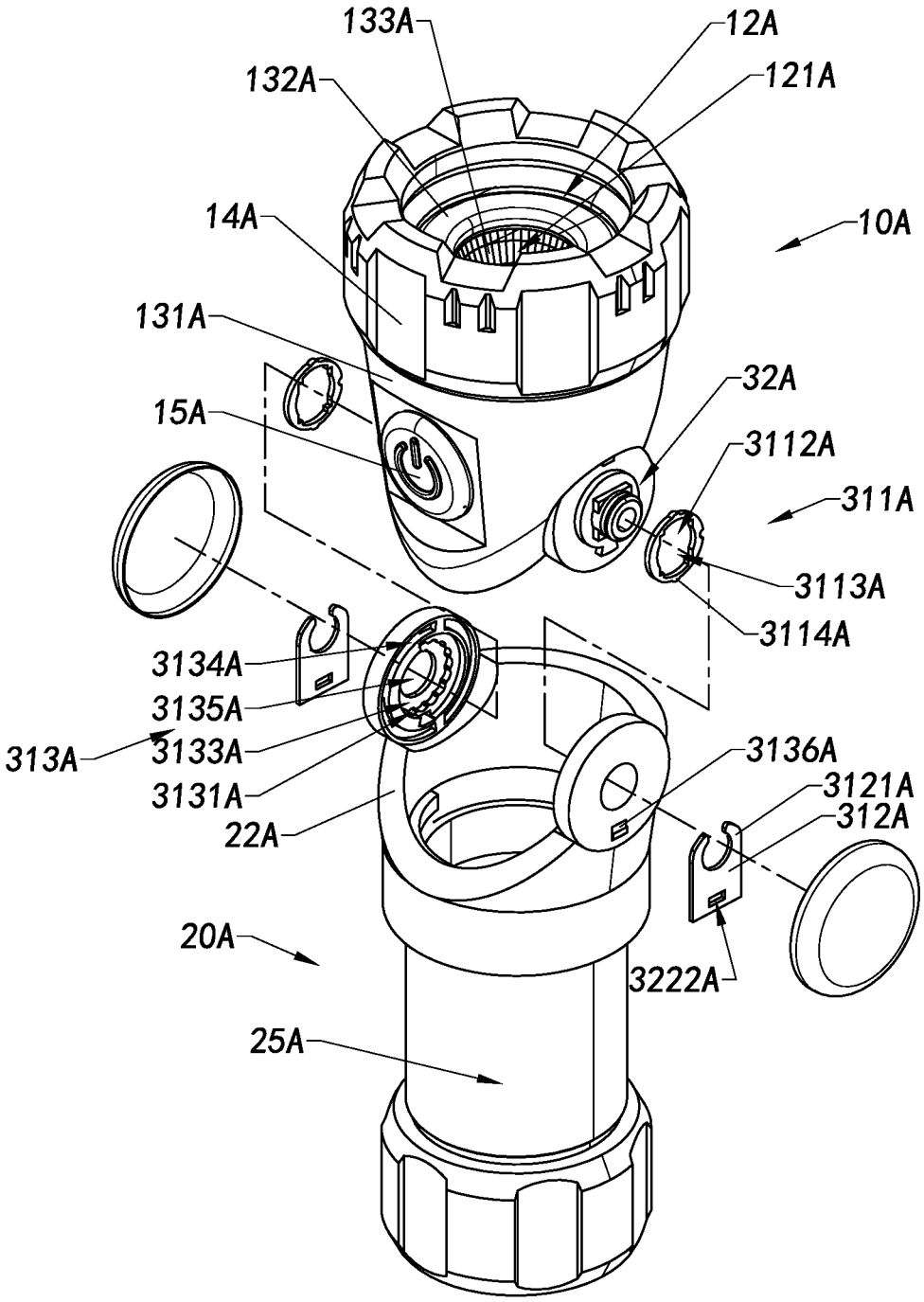
FIG. 12 is an exploded view of the lighting lamp according to the above first preferred embodiment of the present invention.
Figure 13:
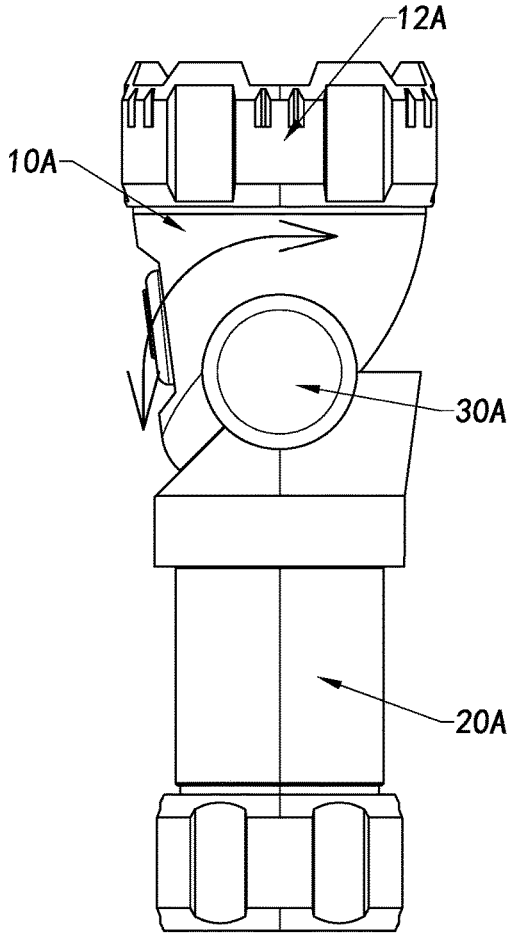
FIG. 13 and FIG. 14 illustrate the adjustment of illumination directions of the lighting lamp according to the above third preferred embodiment of the present invention.
Figure 14:
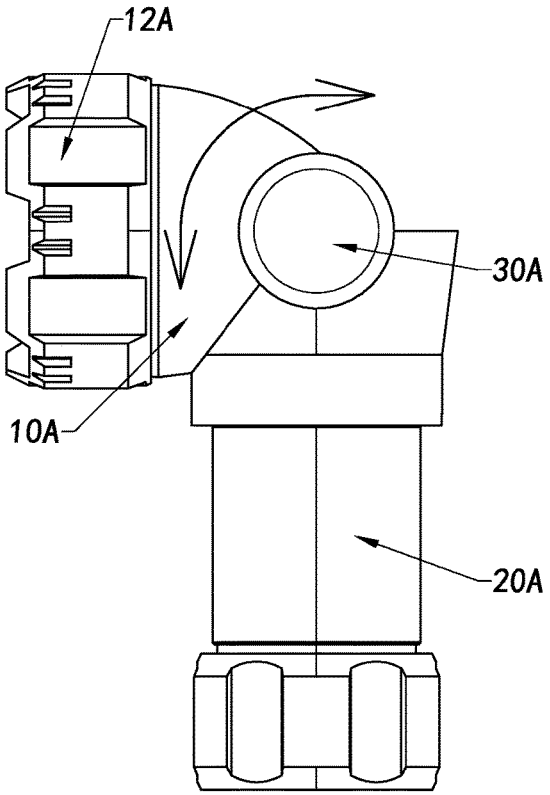

As an alternative mode of the above preferred embodiment, as shown in FIGS. 11 to 13, the lamp head 10A and the lamp body 20A are movably coupled by the connector 30A. The connection angle between the lamp head 10A and the lamp body 20A is changed by an angle whose value is ranged from 0 to 90 degrees under the action of the connector 30A, so that the lighting lamp 100A is capable of being shifted between the first illumination state, the second state, and the third illumination state. The connection angle between the lamp head 10A and the lamp body 20A is from 90 degrees to 180 degrees, and the connector 30A is capable of retaining the lamp head 10A with the lamp body 20A at a connection angle between 90 degrees to180 degrees and does not easily change.

Specifically, different from the above preferred embodiments, the lighting lamp 100A of this third embodiment comprises two connectors 30A, and the connectors 30A are respectively mounted on two sides of one end of the lamp head 10A, and each of the connectors 30A comprises a coupling base 31A and a linkage protrusion 32A movably mounted to the coupling base 31A. The coupling base 31A is integrally connected to the lamp body 20A, and one end of the linkage protrusion 32A is fixedly mounted to the lamp head 10A. In other words, when the linkage protrusion 32A and the coupling base 31A are relative moved, the relative movement between the lamp head 10 and the lamp body 20A is caused, so that a plurality of connection angles are formed between the lamp head 10A and the lamp body 20A, and thus multiple illumination angles are provided. In other words, when the connectors 30A and the lamp body 20A move relative to each other, the connection angle of the lamp head 10A with respect to the lamp body 20A changes, and the illumination element 121A of the lamp head 10A provides an adjusted illumination direction.

The coupling base 31A further comprises a retaining stop 313A and a stopping member 312A. The retaining stop 313A has a fixing hole 3133A, and the linkage protrusion 32A is placed in the fixing hole 3133A, so as to couple the lamp head 10A to the lamp body 20A. The retaining stop 313A further has a plurality of retaining grooves 3131A formed on a hole wall around the fixing holes 3133A. The linkage protrusion 32A is provided with at least two retaining protrusions 3114A which are placed in the retaining grooves 3131A when the linkage protrusions 32A is placed in the fixing hole 3133A. The stopping member 312A is mounted on a surface of the body housing 22A, and the other end of the linkage protrusion 32A is fixedly coupled to the stopping member 312A. The size of the cross-sectional of the stopping member 312A is larger than the aperture size of the fixing hole 3133A, so that the stopping member 312A is able to retain the linkage protrusion 32A in the fixing hole 3133A and the linkage protrusion 32A will not get out from fixing hole 3133A, thereby the lamp head 10A is movably coupled with the lamp body 20A, and also maintain a connection angle between the lamp head 10A and the lamp body 20A at a specific angle to provide a desired illumination direction by the illumination element 121A.

In this preferred embodiment, the retaining protrusions 3114A are preferably symmetrically disposed, and the retaining grooves 3131A are disposed adjacently. When the retaining protrusions 3114A are driven by an external force, each of the retaining protrusions 3114A can be rotated in the fixing hole 3133A by the external force, and is switched to be retained at one of the corresponding retaining grooves 3131A. The specification of each retaining groove 3131A matches with the specification of each corresponding protrusion 3114A, and is slightly larger than the retaining protrusion 3114A. When the fixing member 311A is placed in the fixing hole 3133A, each retaining protrusion 3114A can be disposed in the corresponding retaining groove 3131A. When the retaining protrusion 3114A are rotated in the fixing hole 3133A by the external force, the retaining protrusions 3114A will be sequentially switched to adjacent retaining grooves 3131A. It is worth mentioning that the retaining protrusions 3114A can be transferred from one of the retaining grooves 3131A to the other adjacent retaining groove 3131A only when driven by the external force, thereby avoiding the retaining protrusion 3114A to arbitrarily switch from one of the retaining grooves 3131A to another retaining groove 3131A. Accordingly, the fixing member 311A can be rotated in the fixing hole 3133A in a clockwise direction or a counterclockwise direction by the external force.

The linkage protrusion 32A is mounted and fixed to the lamp head 10A. When the retaining protrusion 311A are rotated clockwise or counterclockwise to switch into each of the retaining grooves 3131A, the lamp head 10A correspondingly rotates clockwise or counterclockwise, thereby changing the connection angle between the lamp head 10A and the lamp body 20A, thereby changing the illumination direction of the illumination element 121A.

It is worth mentioning that the connection angle between the lamp head 10A and the lamp body 20A is arranged between 90 degrees and 180 degrees.

Each of the linkage protrusions 32A is fixedly mounted on one end of the lamp head 10A. When the relative movement between the lamp head 10A and the lamp body 20A occurs, each of the linkage protrusions 32A rotates in each of the fixing holes 3133A respectively. At the same time, the retaining protrusions 3114A of each of the linkage protrusions 32A are sequentially switched in respective adjacent retaining grooves 3131A, so as to change the connection angle between the lamp head 10A and the lamp body 20A. It is to be noteworthy that each of the retaining protrusions 3114A of the linkage protrusions 32A are synchronously switched to the retaining grooves 3131A of the coupling bases 31A, thereby ensuring both sides of one end of the lamp head 10A to synchronously move respect to the lamp body 20A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subject to change without departure from such principles. Therefore, this invention includes all modifications encompassed within the spirit and scope of the following claims.

What is claimed is:

1. A lighting lamp, comprising:

a lamp head for providing an illumination;

a lamp body; and at least one connector movably connecting said lamp head with said lamp body for adjusting an illumination direction of said lamp head, wherein each of said at least one connector comprises:

a coupling base connected to said lamp body; and a linkage protrusion connected to said lamp head, wherein said linkage protrusion is movably connected with said coupling base, and when a relative movement between said coupling base and said linkage protrusion takes place, said lamp head and said lamp body correspondingly move with respect to each other in response to said relative movement between said coupling base and said linkage protrusion, so as to change said illumination direction of said lamp head by changing a connection angle between said lamp head and said lamp body, wherein said linkage protrusion is rotatably connected with said coupling base, wherein said coupling base further comprises:

a retaining stop fixedly mounted on said lamp body, wherein said retaining stop has a fixing hole and a communication hole formed at a bottom of said fixing hole; and a fixing member movably disposed in said fixing hole, wherein said fixing member has a positioning through hole, wherein said positioning through hole is disposed in said fixing hole, wherein said linkage protrusion is placed in said communication hole and said positioning through hole so as to be movably connected to said couple base;

wherein said linkage protrusion is provided with at least one positioning protrusion, wherein said fixing member has at least one receiving hole which is in communication with said positioning through hole, wherein each of said at least one positioning protrusion is disposed in each of corresponding said at least one receiving hole;

wherein said fixing hole is disposed with a plurality of adjacently arranged retaining grooves, wherein said fixing member is provided with a plurality of retaining protrusions, and a specification of each of said retaining grooves matches with a specification of each of said retaining protrusions and is slightly larger than each of said retaining protrusions, wherein each of said retaining protrusions is placed in one of said retaining grooves, wherein when said lamp head is driven to rotate, each of said retaining protrusions will be rotated in response to rotation of said lamp head and sequentially switched into different said retaining grooves, thereby a connection angle between said lamp head and said lamp body is changed accordingly;

wherein said retaining stop further has at least one guiding groove, wherein said linkage protrusion is further provided with at least one guiding member, wherein said at least one guiding member is respectively placed in corresponding said at least one guiding groove, wherein when each of said retaining protrusions is driven to be sequentially switched into different said retaining grooves, said at least one guiding member slides along corresponding said at least one guiding groove.

2. A lighting lamp, comprising:

a lamp head for providing an illumination;

a lamp body; and at least one connector movably connecting said lamp head with said lamp body for adjusting an illumination direction of said lamp head, wherein each of said at least one connector comprises:

a coupling base connected to said lamp body; and a linkage protrusion connected to said lamp head, wherein said linkage protrusion is movably connected with said coupling base, and when a relative movement between said coupling base and said linkage protrusion takes place, said lamp head and said lamp body correspondingly move with respect to each other in response to said relative movement between said coupling base and said linkage protrusion, so as to change said illumination direction of said lamp head by changing a connection angle between said lamp head and said lamp body, wherein said linkage protrusion is rotatably connected with said coupling base, wherein said coupling base further comprises:

a retaining stop fixedly mounted on said lamp body, wherein said retaining stop has a fixing hole and a communication hole formed at a bottom of said fixing hole; and a fixing member movably disposed in said fixing hole, wherein said fixing member has a positioning through hole, wherein said positioning through hole is disposed in said fixing hole, wherein said linkage protrusion is placed in said communication hole and said positioning through hole so as to be movably connected to said couple base;

wherein said linkage protrusion is provided with at least one positioning protrusion, wherein said fixing member has at least one receiving hole which is in communication with said positioning through hole, wherein each of said at least one positioning protrusion is disposed in each of corresponding said at least one receiving hole;

wherein said lamp head and said lamp body move with respect to each other by rotating said linkage protrusion with respect to said coupling base to shift between a first illumination state in which said illumination direction of said lamp head is aligned with an extending direction of said lamp body, and a second illumination state in which said illumination direction of said lamp head is perpendicular to said extending direction of said lamp body;

wherein said coupling base further comprises a stopping member, wherein said stopping comprises a fixing arm at one end thereof and has at least one stopping hole at the other end thereof, wherein said linkage protrusion has a fixing groove, said retaining stop is further provided with at least one stopping protrusion, wherein said fixing arm is placed at said fixing groove, said linkage protrusion is clamped to said fixing arm, said stopping protrusion is disposed at said stopping hole, so as to fix and retain said other end of said stopping member;

wherein said fixing hole is disposed with a plurality of adjacently arranged retaining grooves, wherein said fixing member is provided with a plurality of retaining protrusions, and a specification of each of said retaining grooves matches with a specification of each of said retaining protrusions and is slightly larger than each of said retaining protrusions, wherein each of said retaining protrusions is placed in one of said retaining grooves, wherein when said lamp head is driven to rotate, each of said retaining protrusions will be rotated in response to rotation of said lamp head and sequentially switched into different said retaining grooves, thereby an connection angle between said lamp head and said lamp body is changed accordingly;

wherein when each of said retaining protrusions is rotated in response to rotation of said lamp head and sequentially switched into different said retaining grooves, said lamp head and said lamp body move with respect to each other to shift between said first illumination state, said second illumination state, and a third illuminations state in which said illumination direction of said lamp head and said extending direction of said lamp body define an obtuse angle;

wherein said retaining stop further has at least one guiding groove, wherein said linkage protrusion is further provided with at least one guiding member, wherein said at least one guiding member is respectively placed in corresponding said at least one guiding groove, wherein when each of said retaining protrusions is driven to be sequentially switched into different said retaining grooves, said at least one guiding member slides along corresponding said at least one guiding groove.

3. The lighting lamp, as recited in claim 2, wherein said coupling base further has an inclined supporting surface between said lamp head and said lamp body.

4. A lighting lamp, comprising:

a lamp head for providing an illumination;

a lamp body; and at least one connector movably connecting said lamp head with said lamp body for adjusting an illumination direction of said lamp head, wherein each of said at least one connector comprises:

a coupling base connected to said lamp body; and a linkage protrusion connected to said lamp head, wherein said linkage protrusion is movably connected with said coupling base, and when a relative movement between said coupling base and said linkage protrusion takes place, said lamp head and said lamp body correspondingly move with respect to each other in response to said relative movement between said coupling base and said linkage protrusion, so as to change said illumination direction of said lamp head by changing a connection angle between said lamp head and said lamp body, wherein said linkage protrusion is rotatably connected with said coupling base, wherein said coupling base further comprises:

a retaining stop fixedly mounted on said lamp body, wherein said retaining stop has a fixing hole and a communication hole formed at a bottom of said fixing hole; and a fixing member movably disposed in said fixing hole, wherein said fixing member has a positioning through hole, wherein said positioning through hole is disposed in said fixing hole, wherein said linkage protrusion is placed in said communication hole and said positioning through hole so as to be movably connected to said couple base;

wherein said linkage protrusion is provided with at least one positioning protrusion, wherein said fixing member has at least one receiving hole which is in communication with said positioning through hole, wherein each of said at least one positioning protrusion is disposed in each of corresponding said at least one receiving hole;

wherein said lamp head and said lamp body move with respect to each other by rotating said linkage protrusion with respect to said coupling base to shift between a first illumination state in which said illumination direction of said lamp head is aligned with an extending direction of said lamp body, and a second illumination state in which said illumination direction of said lamp head is perpendicular to said extending direction of said lamp body;

wherein said coupling base further comprises a stopping member, wherein said stopping comprises a fixing arm at one end thereof and has at least one stopping hole at the other end thereof, wherein said linkage protrusion has a fixing groove, said retaining stop is further provided with at least one stopping protrusion, wherein said fixing arm is placed at said fixing groove, said linkage protrusion is clamped to said fixing arm, said stopping protrusion is disposed at said stopping hole, so as to fix and retain said other end of said stopping member;

wherein said fixing hole is disposed with a plurality of adjacently arranged retaining grooves, wherein said fixing member is provided with a plurality of retaining protrusions, and a specification of each of said retaining grooves matches with a specification of each of said retaining protrusions and is slightly larger than each of said retaining protrusions, wherein each of said retaining protrusions is placed in one of said retaining grooves, wherein when said lamp head is driven to rotate, each of said retaining protrusions will be rotated in response to rotation of said lamp head and sequentially switched into different said retaining grooves, thereby a connection angle between said lamp head and said lamp body is changed accordingly;

wherein said lamp head comprises a first circuit unit, wherein said first circuit unit is provided with at least one illumination element, wherein said lamp body comprises a second circuit unit, wherein said second circuit unit is provided with a switch member and a power supply member, wherein by movably connecting said lamp head with said lamp body through said connector, said first circuit unit and said second circuit unit form a complete circuit, wherein when said switch member is in a closed state, said power supply member functions to provide power to said at least one illumination element to provide illumination;

wherein said retaining stop comprises at least two second electrical conductive members, said fixing member comprises at least two first electrical conductive members, and said linkage protrusion comprises at least two third electrical conductive members, wherein by placing said fixing member in said fixing hole, said each of said at least two third electrical conductive members is respectively in contact with each of corresponding said at least two first electrical conductive members and each of corresponding said at least two second electrical conductive members, so that said first circuit unit and said second circuit unit form said complete circuit.

* * * * *